US009315058B2

(12) United States Patent
Yokozawa et al.

(10) Patent No.: US 9,315,058 B2
(45) Date of Patent: Apr. 19, 2016

(54) IMAGE RECORDING APPARATUS, IMAGE RECORDING METHOD, AND NON-TRANSITORY COMPUTER-READABLE STORAGE MEDIUM

(71) Applicant: CANON KABUSHIKI KAISHA, Tokyo (JP)

(72) Inventors: Taku Yokozawa, Yokohama (JP); Hiroaki Shirakawa, Kawasaki (JP); Mitsutoshi Nagamura, Tokyo (JP); Yuhei Oikawa, Yokohama (JP); Yosuke Ishii, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,327

(22) Filed: May 26, 2015

(65) Prior Publication Data

US 2015/0343817 A1 Dec. 3, 2015

(30) Foreign Application Priority Data

May 27, 2014 (JP) ..... 2014-109047

(51) Int. Cl.

| | |
|---|---|
| ***B41J 29/38*** | (2006.01) |
| ***B41J 2/045*** | (2006.01) |
| ***B41J 2/14*** | (2006.01) |

(52) U.S. Cl.

CPC ..... *B41J 29/38* (2013.01); *B41J 2/0454* (2013.01); *B41J 2/0458* (2013.01); *B41J 2/04528* (2013.01); *B41J 2/04551* (2013.01); *B41J 2/04553* (2013.01); *B41J 2/04563* (2013.01); *B41J 2/14153* (2013.01)

(58) Field of Classification Search

CPC ..... B41J 2/454; B41J 2/04565; B41J 2/0458; B41J 2/04563; B41J 2/04573; B41J 2/04588

See application file for complete search history.

(56) References Cited

U.S. PATENT DOCUMENTS 5,886,713 A * 3/1999 Okada ..... B41J 2/0451 347/14
6,086,180 A * 7/2000 Sugimoto ..... B41J 2/0454 347/14

FOREIGN PATENT DOCUMENTS

JP 4-250057 A 9/1992

* cited by examiner

*Primary Examiner* — Juanita D Jackson

(74) *Attorney, Agent, or Firm* — Canon USA Inc. IP Division

(57) ABSTRACT

According to an aspect of the present invention, temperatures at a plurality of different positions in an array direction in an ejection opening array are detected, and heating by a heating element is executed in a case where a temperature difference between the temperatures is higher than a predetermined threshold.

22 Claims, 19 Drawing Sheets

FIG. 9

| RECORDING MODE | HIGH SPEED RECORDING MODE | STANDARD RECORDING MODE | HIGH IMAGE QUALITY RECORDING MODE |
|---|---|---|---|
| Tth | 3°C | 5°C | 10°C |

FIG. 12A

| RECORDING MEDIUM | GLOSSY PAPER | COATED PAPER | PLAIN PAPER |
|---|---|---|---|
| Tth | 3°C | 5°C | 10°C |

FIG. 12B

| RECORDING DUTY | BELOW 30% | 30% TO 50% | ABOVE 50% |
|---|---|---|---|
| Tth | 10°C | 3°C | 10°C |

FIG. 12C

| HUMIDITY | BELOW 15% | 15% TO 60% | ABOVE 60% |
|---|---|---|---|
| Tth | 3°C | 5°C | 10°C |

FIG. 14

| TEMPERATURE SENSOR VALUE Tmax | Tth |
|---|---|
| 40 TO 45°C | 2°C |
| 46 TO 50°C | 3°C |
| 51 TO 55°C | 3.5°C |
| 56 TO 60°C | 3.5°C |

FIG. 17

| RECORDING MODE | HIGH SPEED RECORDING MODE | STANDARD RECORDING MODE | HIGH IMAGE QUALITY RECORDING MODE |
|---|---|---|---|
| Tthon | 3°C | 5°C | 10°C |
| Tthoff | 1°C | 3°C | 9°C |

FIG. 19A

| RECORDING MODE | HIGH SPEED RECORDING MODE | | |
|---|---|---|---|
| CENTRAL PART TEMPERATURE SENSOR VALUE | 40 TO 45°C | 46 TO 50°C | 51 TO 60°C |
| Tth | 2°C | 3°C | 3.5°C |

FIG. 19B

| RECORDING MODE | STANDARD RECORDING MODE | | |
|---|---|---|---|
| CENTRAL PART TEMPERATURE SENSOR VALUE | 40 TO 45°C | 46 TO 50°C | 51 TO 60°C |
| Tth | 3°C | 5°C | 7°C |

FIG. 19C

| RECORDING MODE | HIGH IMAGE QUALITY RECORDING MODE | | |
|---|---|---|---|
| CENTRAL PART TEMPERATURE SENSOR VALUE | 40 TO 45°C | 46 TO 50°C | 51 TO 60°C |
| Tth | 7°C | 10°C | 12°C |

IMAGE RECORDING APPARATUS, IMAGE RECORDING METHOD, AND NON-TRANSITORY COMPUTER-READABLE STORAGE MEDIUM

BACKGROUND OF THE INVENTION

1. Field of the Invention

The present invention relates to an image recording apparatus, an image recording method, and a non-transitory computer-readable storage medium.

2. Description of the Related Art

Up to now, an image recording apparatus in which ink is ejected while a recording head having an ejection opening array constructed by arranging a plurality of ejection openings for ejecting ink is scanned with respect to a recording medium to record an image on the recording medium has been proposed.

In the above-described image recording apparatus, a recording system where an electrothermal transducing element is used, and thermal energy generated when a pulse is supplied to the electrothermal transducing element is utilized to eject the ink from the ejection openings has been proposed. According to the above-described recording system, even when the thermal energy is uniformly applied to the plurality of ejection openings in the ejection opening array, a temperature distribution of the ink in accordance with array positions of the ejection openings may be generated in some cases. Since the ejection amount of ink is increased as a temperature of the ink is higher, the ejection amount fluctuates among the ejection openings in accordance with this temperature distribution, and as a result, density unevenness may occur in the image to be recorded.

To suppress the above-described density unevenness, Japanese Patent Laid-Open No. 4-250057 discloses that a recording head including a plurality of temperature sensors arranged at mutually different positions in an array direction of the ejection openings and a temperature adjustment heater that performs a temperature adjustment by heating an area in the vicinity of the ejection opening (hereinafter, will be also referred to as sub heater) is used. In more detail, a recording head including two sub heaters that can be mutually independently driven which are arranged in the vicinity of one end part and the vicinity of the other end part is disclosed. Japanese Patent Laid-Open No. 4-250057 describes that, even in a case where a temperature difference of the ink between the vicinity of one end part and the vicinity of the other end part in the ejection opening array occurs in a recording mode for performing the recording by decreasing the number of ejection openings used for the recording, the temperature difference between the end parts can be eliminated by making power settings in accordance with the temperature difference in the respective sub heaters and independently driving the sub heaters while the above-described recording head is used.

However, with the recording head of recent years, it is found that, even in a recording mode in which all of the plurality of ejection openings in the ejection opening array are used, for example, a temperature distribution in which a temperature on a central side in the ejection opening array is higher than a temperature on an end part side may occur in some cases. In a case where the above-described temperature distribution occurs, density unevenness may occur in an area between an area recorded from the central side in the ejection opening array and an area recorded from the end part side in the ejection opening array on the recording medium.

It is conceivable that this temperature distribution is derived, for example, from a state where heat dissipation via a substrate more easily occurs in the end part in the ejection opening array and the temperature is more easily decreased than the central part. In recent years, to suppress a landing position deviation of the ink in the ejection from the end part in the ejection opening array, a technique has been proposed with which the ejection amount from the end part side in the ejection opening array is set to be lower than the ejection amount from the central side to perform the recording. In this case, the number of times to drive the electrothermal transducing element corresponding to the ejection opening located on the central side in the ejection opening array is increased, and the above-described temperature distribution may more notably occur.

According to the technology described in Japanese Patent Laid-Open No. 4-250057, since the sub heaters are provided only in both end parts in the ejection opening array, the temperature distribution is not eliminated in the above-described case where the temperature at the central part in the ejection opening array is higher than the temperature at both the end parts. In addition, since a configuration of an electric circuit or the like becomes complicated in the recording head that can independently drive the plurality of sub heaters as in Japanese Patent Laid-Open No. 4-250057, an increase in a size of the recording head and an increase in costs may occur.

In addition, as described in Japanese Patent Laid-Open No. 4-250057, it is found that, even in a case where driving of the sub heaters is controlled so as to eliminate the temperature distribution by calculating a temperature difference between a temperature detected from a temperature sensor arranged in the vicinity of the ejection opening used for the recording and a temperature detected from a temperature sensor arranged in the vicinity of the ejection opening that is not used for the recording, the following problem may occur. In a case where a use frequency of the ejection opening used for the recording is high, the temperature of the temperature sensor in its vicinity is increased, and the temperature difference from the temperature sensor arranged in the vicinity of the ejection opening that is not used for the recording is expanded, so that the power of the sub heater in the vicinity of the ejection opening that is not used for the recording is to be further increased. As a result, the detection temperature difference and the temperature distribution are to be eliminated, but the entire recording head accumulates heat, and the temperature is increased. Thus, it is found that a state of an excessive increase in the temperature is established, and an ejection performance may be decreased.

SUMMARY OF THE INVENTION

The present invention has been made in view of the above-described problem and aims at performing recording while density unevenness derived from a temperature distribution in which a temperature on a central side in an ejection opening array is higher than a temperature on an end part side in the ejection opening array is suppressed.

In view of the above, according to an aspect of the present invention, there is provided an image recording apparatus that includes a recording head including at least a substrate, a recording element array in which a plurality of recording elements that are arranged on the substrate in a predetermined direction and generate thermal energy for ejecting ink of a predetermined color, a first detection element that detects a temperature in a vicinity of the recording element at a first position in the predetermined direction in the recording element array, a second detection element that detects a temperature in a vicinity of the recording element at a second position that is different from the first position in the predetermined direction in the recording element array, and a heating element that performs heating of ink in the vicinity of the plurality of recording elements arranged in the recording element array, and a control unit that controls heating by the heating element on the basis of the temperatures detected by the first and second detection elements, in which the control unit controls the heating by the heating element in a manner that the heating by the heating element is executed in a case where a temperature difference between the temperature detected by the first detection element and the temperature detected by the second detection element is higher than a first threshold.

Further features of the present invention will become apparent from the following description of exemplary embodiments with reference to the attached drawings.

BRIEF DESCRIPTION OF THE DRAWINGS

FIG. 9 is a table diagram illustrating a threshold in accordance with a recording condition according to the exemplary embodiment.

FIGS. 12A, 12B, and 12C are table diagrams illustrating the thresholds in accordance with the recording condition according to the exemplary embodiment.

FIG. 14 is a table diagram illustrating the threshold in accordance with the recording condition according to the exemplary embodiment.

FIG. 17 is a table diagram illustrating the threshold in accordance with the recording condition according to the exemplary embodiment.

FIGS. 19A, 19B, and 19C are table diagrams illustrating the threshold in accordance with the recording condition according to the exemplary embodiment.

DESCRIPTION OF THE EMBODIMENTS

Hereinafter, a first exemplary embodiment of the present invention will be described in detail with reference to the drawings.

First Exemplary Embodiment

Figure 1:
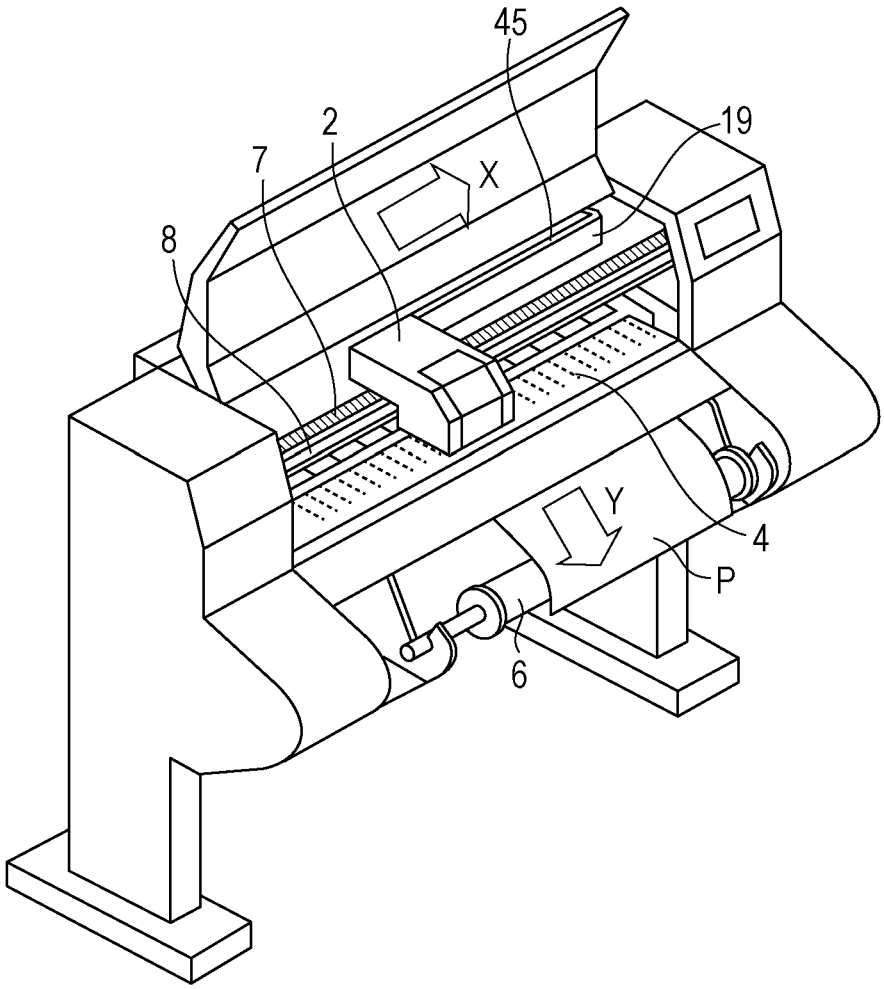
FIG. 1 is a perspective view of an image recording apparatus according to an exemplary embodiment.

(1) Mechanical Configuration of an Image Recording Apparatus (1-1) Outline of the Apparatus FIG. 1 illustrates an external appearance of an image recording apparatus (hereinafter, will be also referred to as printer) according to an exemplary embodiment of the present invention. This printer is a so-called serial scanning type printer and is configured to scan a recording head in a scanning direction (X direction) perpendicular to a conveyance direction (Y direction) of a recording medium P to record an image.

A configuration of this image recording apparatus and an outline of an operation at the time of recording will be described by using FIG. 1. First, the recording medium P is conveyed in the Y direction by a sheet feeding roller driven via a gear by a sheet feeding motor that is not illustrated in the drawing from a spool 6 that holds the recording medium P. Whereas, a carriage unit 2 is scanned along a guide shaft 8 extending in the X direction at a predetermined conveyance position by a carriage motor that is not illustrated in the drawing. Subsequently, in the process of this scanning, an ejection operation from the ejection openings is performed by a recording head (described below) which can be detachably attached to the carriage unit 2 at a timing based on a positional signal obtained by an encoder 7, and a certain band width corresponding to a nozzle array range is recorded. According to the present exemplary embodiment, a configuration is adopted in which the scanning is performed at a scanning speed at 40 inches/second, and the ejection operation is performed at a timing of 600 dpi. Thereafter, the conveyance of the recording medium is performed, and the recording for the next band width is further performed according to the configuration.

In the above-described printer, the image may be recorded in a unit area on the recording medium by performing the scanning once (so-called one-pass recording), or the image may be recorded by performing the scanning plural times (so-called multi-pass recording). In a case where the one-pass recording is performed, the conveyance of the recording medium by an amount corresponding to the band width may be performed between the respective scanning operations. On the other hand, in a case where the multi-pass recording is performed, a configuration may be adopted that the conveyance is not performed for each scanning, and after the scanning is performed plural times with respect to the unit area on the recording medium, the conveyance by an approximate amount corresponding to the one band is performed in this unit area. In addition, as the other multi-pass recording, a method has been proposed with which sheet feeding by an approximate amount corresponding to the 1/n band is performed after data thinned out by a predetermined mask pattern is recorded for each scanning, and the scanning is performed again, so that the image is completed by performing the scanning and the conveyance plural times (n times) with respect to the unit area on the recording medium by varying nozzles involved in the recording.

A flexible printed circuit board (not illustrated) for supplying a signal pulse for ejection driving, a head temperature adjustment signal, and the like is attached to a recording head 9. The other end of the flexible printed circuit board is connected to a control circuit (described below) which includes a control circuit that executes a control of this printer.

It is noted that a carriage belt can be used for transmission of driving force to the carriage unit 2 from the carriage motor. However, instead of the carriage belt, other driving methods can also be used. For example, a mechanism including a lead screw that is rotated and driven by the carriage motor and extends in a main scanning direction and an engagement portion that is provided to the carriage unit 2 and engaged in a groove of the lead screw or the like can be used.

The fed recording medium P is nipped by a sheet feeding roller and a pinch roller and conveyed to be guided to a recording position on a platen 4 (main scanning area of the recording head 9). In general, since a capping is applied to an orifice face of the recording head 9 in a pause state, the capping is released before the recording is started to put the recording head 9 and the carriage unit 2 in a state in which the scanning can be performed. Thereafter, once data for one scanning is accumulated in a buffer, the carriage unit 2 is scanned by a carriage motor 3, and the recording is performed in the above-described manner.

(1-2) Configuration of the Recording Head

Figure 2:
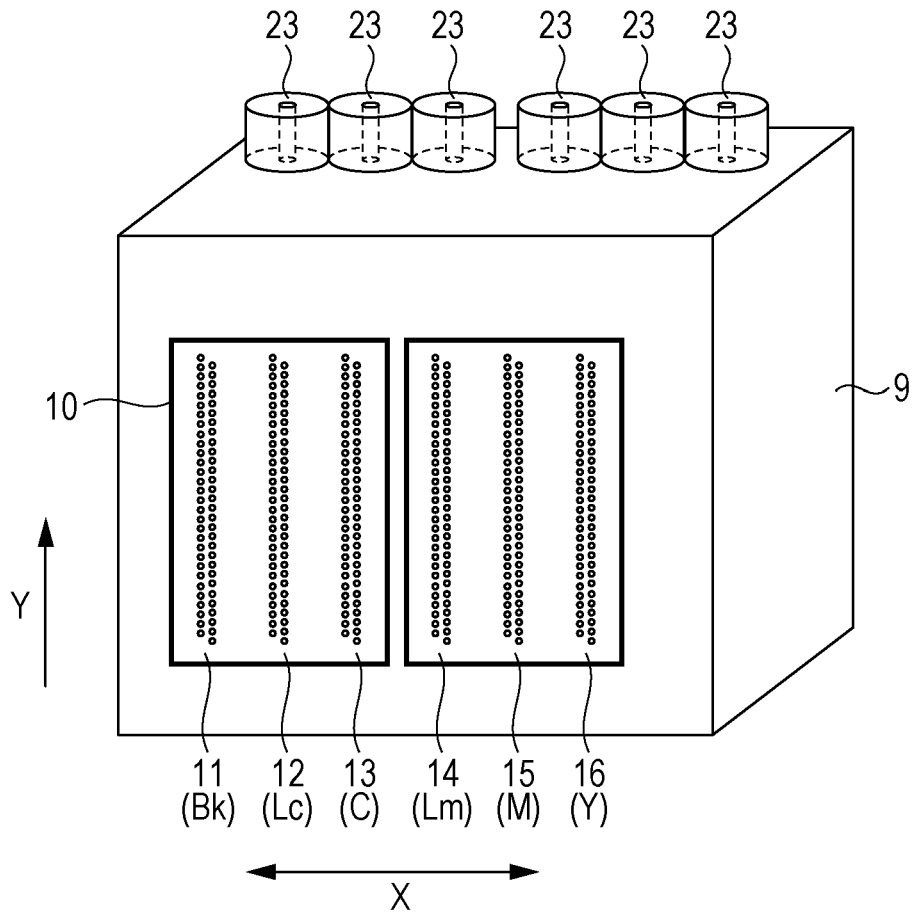
FIG. 2 is a schematic view of a recording head according to the exemplary embodiment.

FIG. 2 is a schematic perspective view of the recording head 9 mounted to the carriage unit 2 of the above-described printer as viewed from a direction in which the ink is ejected. Herein, a plurality of ejection opening arrays 11 to 16 that can eject ink of different color tones (including colors and densities) in the X direction including, for example, ink of black (Bk), light cyan (Lc), cyan (C), light magenta (Lm), magenta (M), and yellow (Y) are arranged on two support substrates 10 side-by-side on the recording head 9. Ink is supplied from ink introduction portions 23 via ink passages inside the recording head 9 to the respective ejection opening arrays. The ink is introduced from ink tanks via supply tubes 45 to the ink introduction portions 23.

Figure 3A:
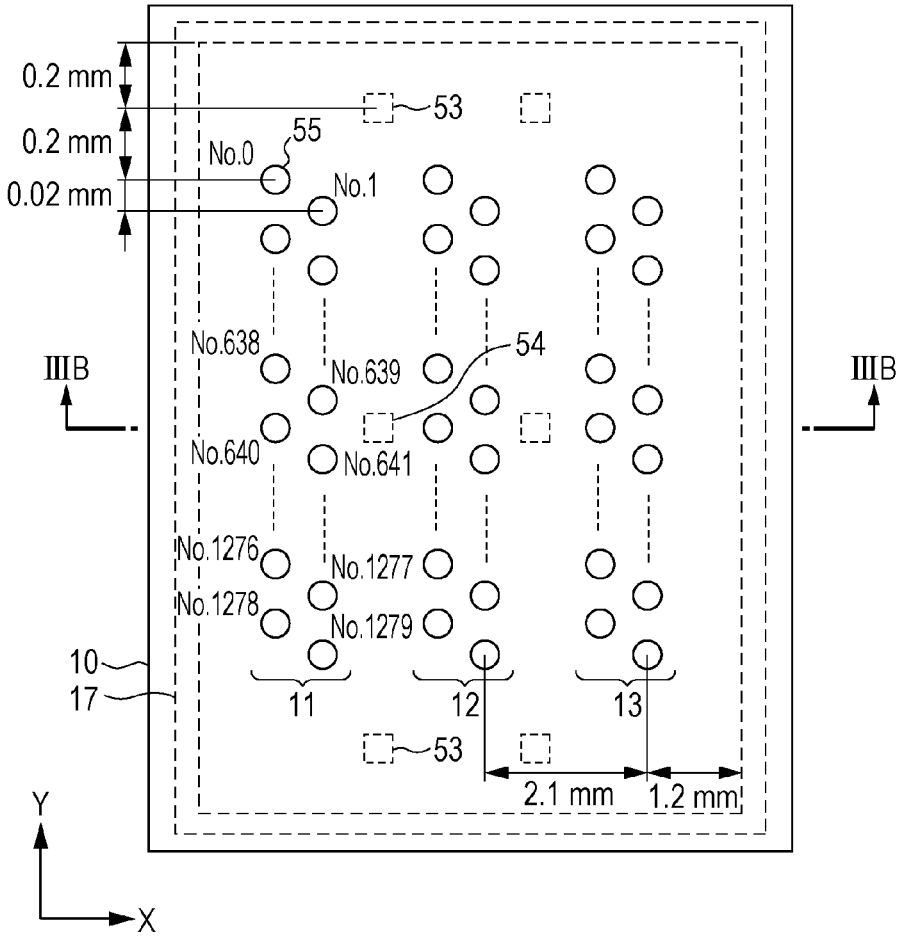
FIGS. 3A and 3B are perspectives of the recording head according to the exemplary embodiment.
Figure 3B:
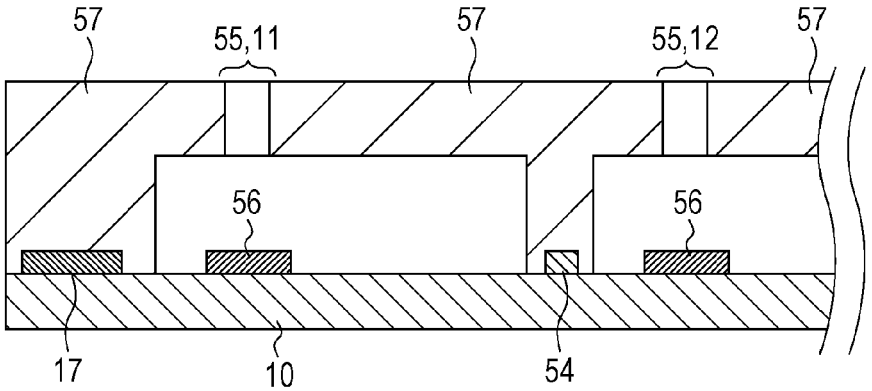

FIGS. 3A and 3B are perspectives for describing a detailed configuration of the support substrate 10 formed, for example, of a semiconductor. It is noted that FIG. 3A is the perspective of the support substrate 10 as viewed from a direction perpendicular to an XY plane. FIG. 3B is the perspective of a position of a straight line IIIB-IIIB illustrated in FIG. 3A in a case where the support substrate 10 is viewed from a downstream side in the Y direction.

FIGS. 3A and 3B correspond to the ejection opening arrays 11 to 13 among the two support substrates 10 arranged side-by-side on the recording head 9. It is noted that, for simplicity, FIGS. 3A and 3B illustrate components having scale sizes different from actual scale sizes. The ejection opening arrays 11 to 13 according to the present exemplary embodiment are respectively formed of two arrays each. The ejection opening arrays 11 to 13 and electrothermal transducing element arrays (recording element arrays) are formed in the following manner. 640 each per array, and 1280 in total of ejection openings 55 and electrothermal transducing elements (also referred to as recording elements or main heaters) 56 facing the ejection openings 55 are arranged in the Y direction (predetermined direction) while these two arrays are shifted from each other by 1200 dots/inch (dpi) with respect to the facing array in the Y direction (predetermined direction). It is noted that 1200 dpi is equivalent to approximately 0.02 mm according to the present exemplary embodiment. While this electrothermal transducing element is applied with a pulse, it is possible to generate thermal energy for ejecting the ink from the ejection opening. The case where the electrothermal transducing elements are used has been described herein, but it is also possible to use piezoelectric elements and the like. An end part temperature sensor (detection element) 53 constituted by a diode that detects a temperature of the end part of the support substrate 10 is formed on the support substrate 10 and in the end part in the Y direction in the ejection opening array. The end part temperature sensor 53 is formed in a position in-between two ejection opening arrays (for example, the ejection opening arrays 11 and 12) with respect to the X direction and away from the ejection opening in the end part by 0.2 mm with respect to the Y direction, and a configuration is adopted in which the one end part temperature sensor 53 detects the end part temperature in the two ejection opening arrays. A central part temperature sensor (detection element) 54 constituted by a diode that detects a temperature of the central part in the ejection opening array is formed in the central part in the Y direction in the ejection opening array, and a configuration is adopted in which the one central part temperature sensor 54 detects a central part temperature in the two ejection opening arrays. A sub heater (heating element) 17 that adjusts a temperature of the ink in the ejection opening is formed as one continuous member surrounding the three ejection opening arrays 11 to 13 is located on an outer side of a nozzle array 15 by 1.2 mm with respect to the X direction and an outer side of a temperature sensor 20 by 0.2 mm with respect to the Y direction. It is noted that, as schematically illustrated in FIG. 3B, the sub heater 17 and the central part temperature sensor 54 are formed so as to be engaged with the support substrate 10 inside an ejection opening member 57 provided on the support substrate 10. The electrothermal transducing element 56 is formed so as to be engaged with the support substrate 10 in the ink passage.

(2) Configuration Example of a Control System

Figure 4:
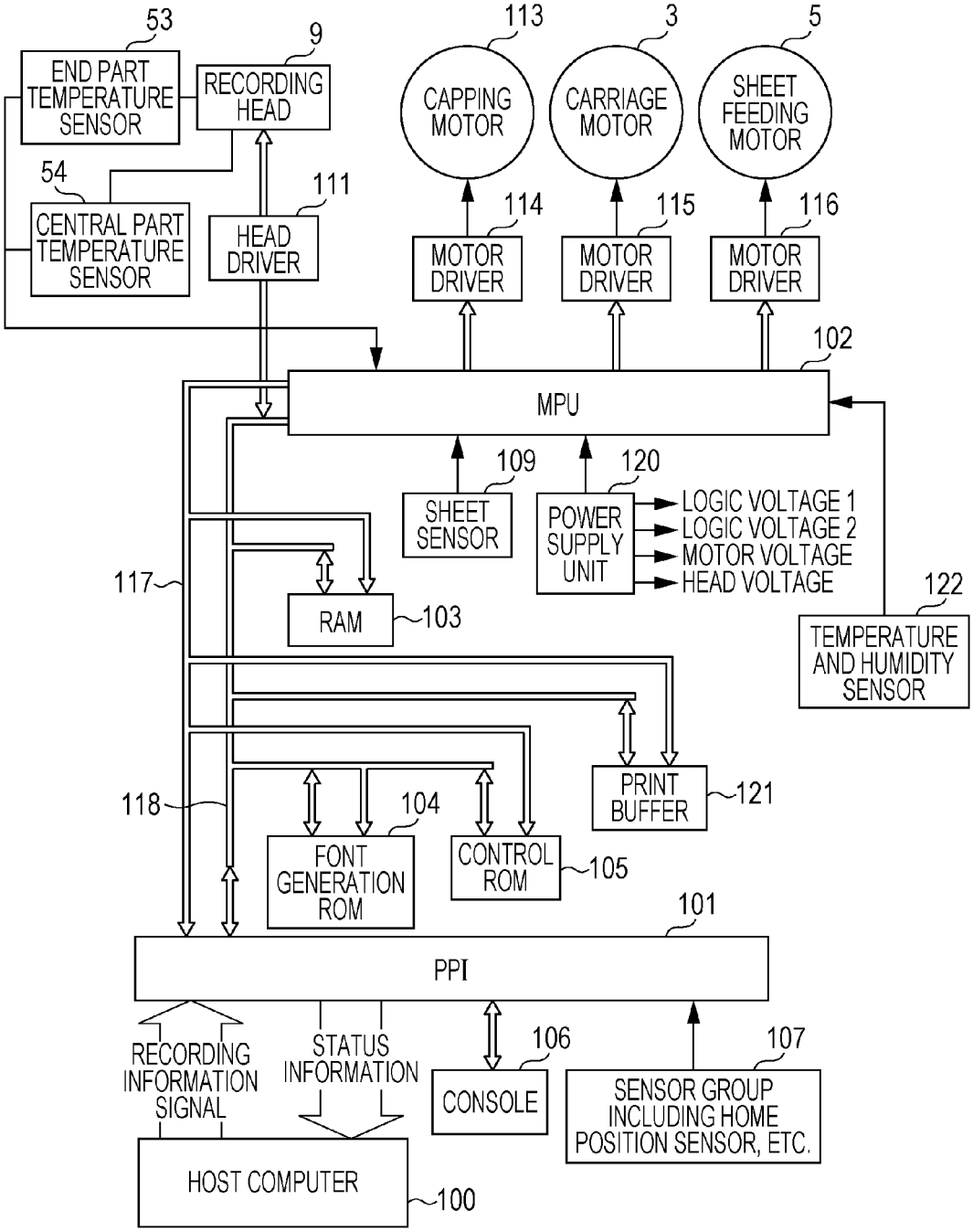
FIG. 4 is a schematic view for describing a recording control system according to the exemplary embodiment.

FIG. 4 illustrates a configuration example of a control circuit of the image recording apparatus used according to the present exemplary embodiment. In FIG. 4, a programmable peripheral interface (hereinafter, referred to as PPI) 101 receives an instruction signal (command) and a recording information signal including recording data which are transmitted from a host computer 100 and transfers these signals to a micro processing unit (MPU) 102, and also transmits status information of the printer to the host computer 100 when needed. The PPI 101 also performs input and output with a console 106 including a setting input unit with which a user performs various settings to the printer, a display unit that displays a message to the user, and the like, and receives signal inputs from a sensor group 107 including a home position sensor that detects that the carriage unit 2 and the recording head 9 are at a home position, a capping sensor, and the like.

The MPU 102 controls respective units in the printer in accordance with a control program stored in a control ROM 105. A RAM 103 stores received signals or is used as a work area of the MPU 102 and temporarily stores various pieces of data. A font generation ROM 104 stores pattern information such as characters and recording while corresponding to code information and outputs various pattern information while corresponding to the input code information. A print buffer 121 stores recording data rasterized onto the RAM 103 or the like and has a capacity corresponding to recording of a plurality of rows. The control ROM 105 can store not only the above-described control program but also fixed data corresponding to program data used in the process of a control described below (for example, data for the MPU to determine a starting timing of a sub heater control related to the main parts according to the present exemplary embodiment) or the like. These respective units are controlled by the MPU 102 via an address bus 117 and a data bus 118. The MPU 102 also obtains the temperatures detected from the end part temperature sensor 53 and the central part temperature sensor 54 which are arranged in the recording head 9 and generates the above-described program data on the basis of these temperatures.

Motor drivers 114, 115, and 116 respectively drive a capping motor 113, the carriage motor 3, and a sheet feeding motor 5 in accordance with the control of the MPU 102.

A sheet sensor 109 detects the presence or absence of the recording medium, that is, whether or not the recording medium is supplied to a position where the recording by the recording head 9 can be performed. A driver 111 drives a heat generation unit (main heater, sub heater) of the recording head 9 in accordance with the above-described program data. A temperature and humidity sensor 122 detects an environment temperature and an environment humidity in an installment environment of the printer main body. A power supply unit 124 supplies power to the above-described respective units and includes an AC adopter and a buttery as a driving power supply apparatus.

In a recording system constituted by the above-described printer and the host computer 100 that supplies the recording information signal to the printer, when the recording data is transmitted by the host computer 100 via a parallel port, an infrared port, a network, or the like, required commands are added to its leading part. The commands include, for example, a type of the recording medium on which the recording is performed (a type such as plain paper, OHP sheet, or glossy paper, and furthermore, a type of a special recording medium such as transfer film, heavy paper, or banner paper), a medium size (A0, A1, A2, B0, B1, B2, or the like), a recording quality (draft, high quality, medium quality, emphasis on a particular color, a type of monochrome/color, or the like), a sheet feeding path (ASF, manual sheet feeding, sheet feeding cassette 1, sheet feeding cassette 2, or the like set in accordance with a mode and a type of feeding unit of the recording medium of the printer, for example), the presence or absence of automated discrimination for an object, and the like. In a case where a configuration in which application of treatment liquid for improving a fixing property of the ink on the recording medium is performed is adopted, information for setting the presence or absence of the application or the like may be transmitted as a command in some cases.

Pieces of data used for the recording are read on the printer side from the control ROM 105 described above in accordance with these commands, and the recording is performed on the basis of those pieces of data. The data includes, for example, data for determining the number of recording passes when the above-described multi-pass recording is performed, the ink ejection amount per the recording medium unit area, the recording direction, and the like. In addition to the above, the data includes a mask type for the data thinning applied when the multi-pass recording is performed, a driving condition of the recording head 9 (for example, a shape of a driving pulse applied to the heat generation unit, an application time, or the like), a size of a dot, a condition for the recording medium conveyance, the number of colors to be used, and furthermore, a carriage speed, and the like.

Hereinafter, an example of the driving control of the sub heater according to the present exemplary embodiment will be described in detail.

Figure 5:
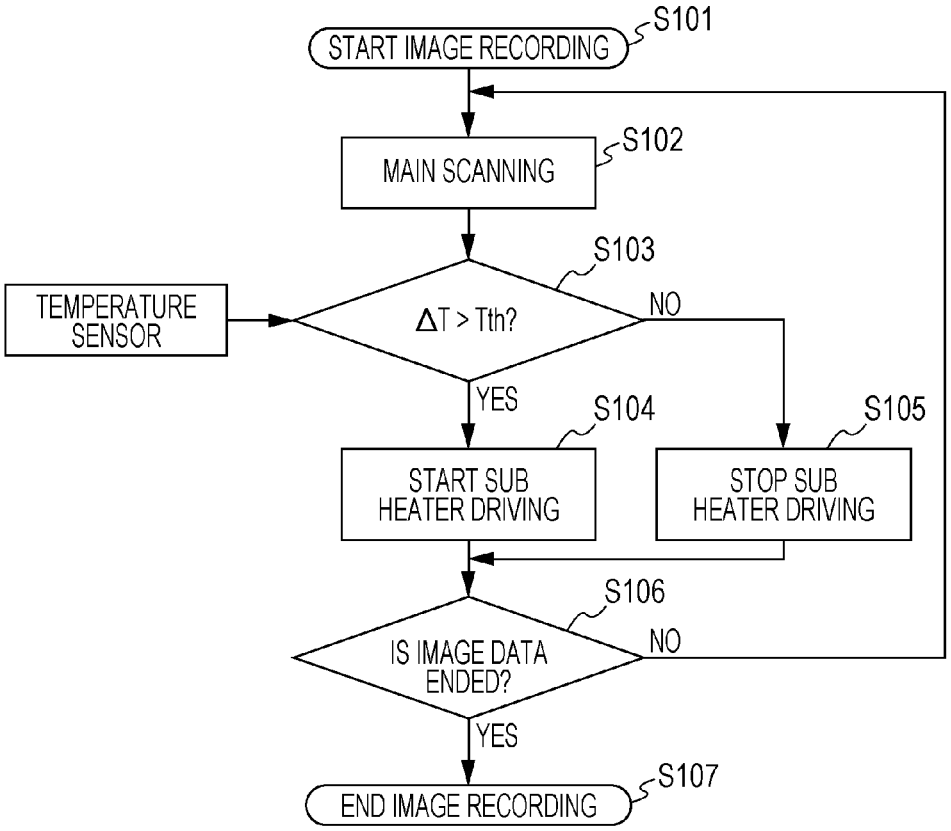
FIG. 5 is an explanatory diagram for describing a driving control of a sub heater according to the exemplary embodiment.

FIG. 5 is a flow chart for describing a flow of a control for changing a threshold of the sub heater according the present exemplary embodiment in accordance with the number of times to perform the scanning with respect to the unit area.

When the recording of the image is started (step S101), first, the main scanning of the recording head on the recording medium is started (step S102). Subsequently, a difference (temperature difference) ΔT (° C.) between the temperature detection value from the end part temperature sensor 53 and the temperature detection value from the central part temperature sensor 54 is calculated to start comparison with a previously set threshold Tth (° C.) (step S103). According to the present exemplary embodiment, the threshold Tth (° C.) is set as 3° C. The threshold Tth (° C.) can be appropriately set as a different value. An appropriate value for eliminating the temperature different is calculated by a simulation or the like, and information related to the value can be previously stored in the control ROM 105 in the recording apparatus.

When it is determined that the temperature difference ΔT (° C.) is higher than the threshold Tth, to reduce the temperature difference between the end part side and the central side, driving of the sub heater is started (step S104). On the other hand, the temperature difference ΔT (° C.) when it is determined that the temperature difference ΔT (° C.) is lower than or equal to the threshold Tth, the sub heater is not driven (step S105). In a case where the driving of the sub heater is already executed at that time, the driving of the sub heater is stopped.

Thereafter, it is determined whether or not the image recording is ended (step S106), and when the recording of all the data is ended, the image recording operation is ended (step S107). In a case where the recording of all the data is not ended, the flow returns to step S102, and the similar processing is continued until the data is ended.

Figure 6A:
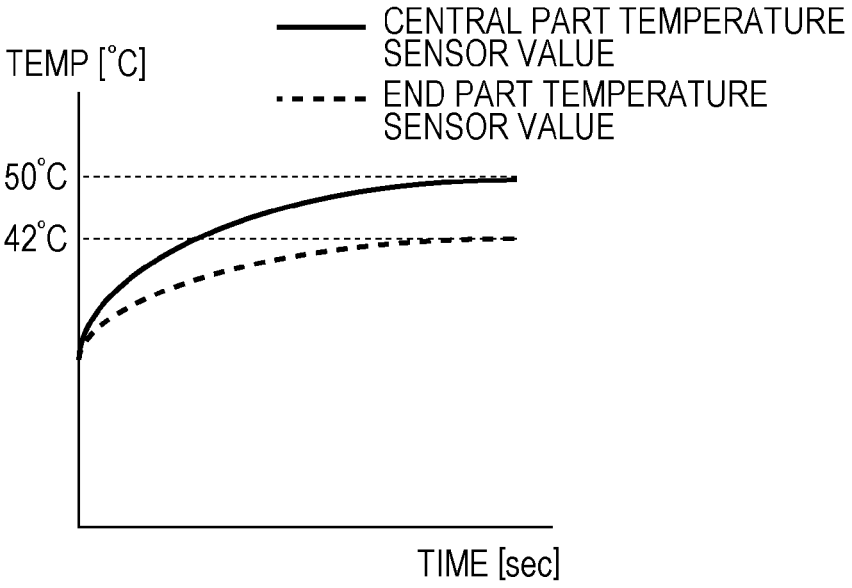
FIGS. 6A and 6B are explanatory diagrams for describing a temperature transition according to the exemplary embodiment.
Figure 6B:
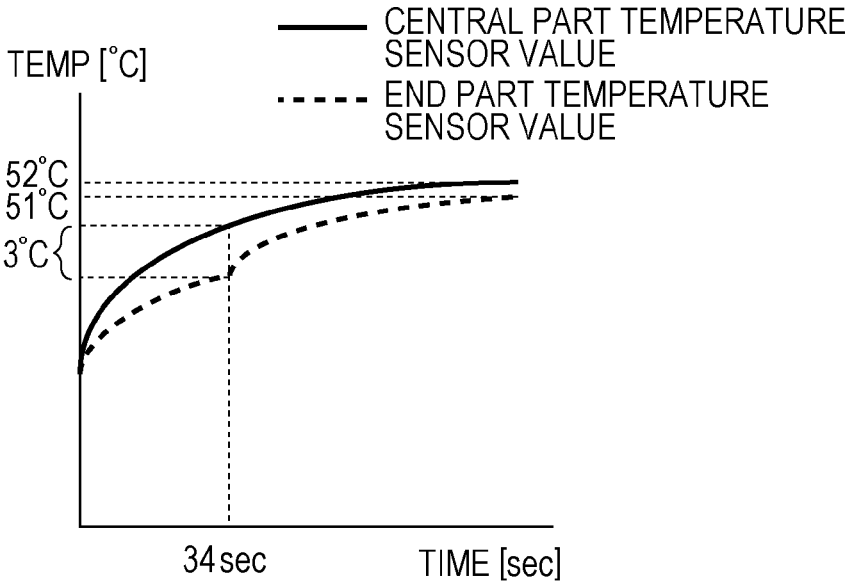

FIGS. 6A and 6B illustrate the temperature transition of the end part temperature sensor value and the central part temperature sensor value during the recording depending on the presence or absence of the control based on the flow described in FIG. 5.

FIG. 6A illustrates the temperature transition of the ejection opening array 12 in a case where an image of an A0 size light cyan 100% duty is recorded without applying the present exemplary embodiment to the configuration. Herein, the head temperature is increased to 35° C. before the recording is started by the temperature adjustment control using the sub heater and the electrothermal transducing element used for ejecting the ink before the recording is started, and then the recording is started. To perform 100% duty recording, the ink is ejected from the respective ejection openings in the ejection opening array 12 at a substantially uniform frequency. However, the area on the end part side in the Y direction tends to dissipate the heat via the support substrate 10 to open air, and it tends to be more difficult for the temperature to increase as compared with the central part. Therefore, in 108 seconds later when the recording is ended, the end part temperature sensor value becomes approximately 42° C., and the central part temperature sensor value becomes approximately 50° C.

On the other hand, FIG. 6B illustrates the temperature transition of the ejection opening array 12 in a case where the similar recording is executed while the present exemplary embodiment is applied to the configuration. After an elapse of 34 seconds since the recording is started, the temperature difference between the end part temperature sensor value and the central part temperature sensor value exceeds 3° C., and the heating by the sub heater 17 is started. Since the sub heater centrally heats the end part side in the Y direction where the heat dissipation is likely occur, the increase speed of the end part temperature sensor value is accelerated. For that reason, the temperature difference between the central part temperature sensor value and the end part temperature sensor value is diminished, and the temperature difference at the time of the recording end is approximately 1° C. It is however noted that the temperature of the entire recording head is slightly increased because of the heating by the sub heater, and the recording is ended while the end part temperature sensor value is approximately 51° C., and the central part temperature sensor value is approximately 52° C.

Figure 7A:
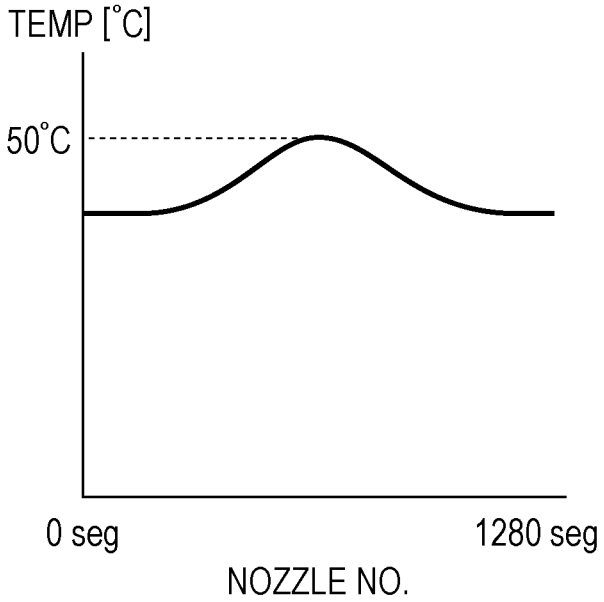
FIGS. 7A and 7B illustrate a temperature distribution according to the exemplary embodiment.
Figure 7B:
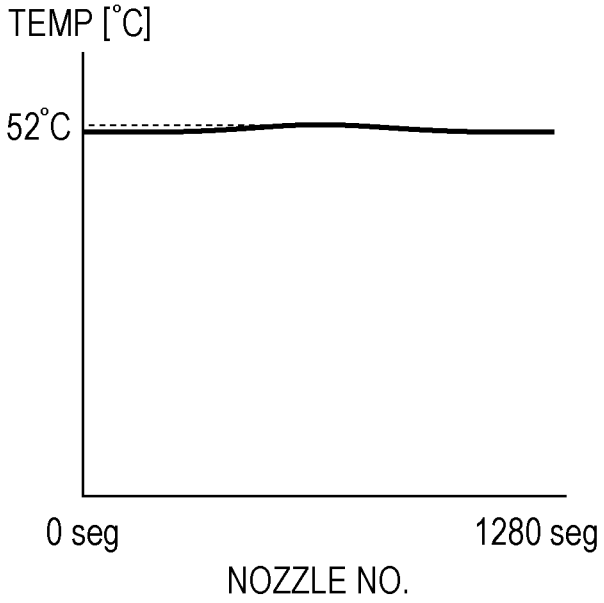

FIGS. 7A and 7B illustrate the temperature distribution of the ejection opening array 12 at the time of the recording end. FIG. 7A illustrates the temperature distribution in a case where the present exemplary embodiment is not applied to the configuration, and FIG. 7B illustrates the temperature distribution in a case where the present exemplary embodiment is applied to the configuration.

In a case where the present exemplary embodiment is not applied to the configuration, as illustrated in FIG. 7A, the temperature distribution in which the temperature in the central part in the ejection opening array is high and the temperature in the end part is low is obtained. In contrast to this, by applying the present exemplary embodiment to the configuration, as illustrated in FIG. 7B, the temperature distribution in the ejection opening array becomes substantially uniform.

In this manner, according to the present exemplary embodiment, the sub heater is driven in a case where the temperature difference is higher than the threshold, and the driving of the sub heater is stopped in a case where the temperature difference is lower than or equal to the threshold. Thus, the temperature distribution in the ejection opening array (in the recording element array) is set to be substantially uniform, and the density unevenness derived from the temperature distribution can be appropriately suppressed.

Second Exemplary Embodiment

According to the present exemplary embodiment, a different threshold is set in accordance with the number of times to perform the scanning with respect to the unit area on the recording medium by the recording head.

It is noted that descriptions on parts similar to the above-described first exemplary embodiment will be omitted.

When the recording is performed by the multi-pass recording method with which the scanning is performed plural times with respect to the unit area on the recording medium to perform the recording, even in a case where the temperature difference in the ejection opening array is the same, if the number of times to perform the scanning with respect to the unit area is relatively high, the density unevenness is not so conspicuous. If the number of times to perform the scanning with respect to the unit area is relatively low, the density unevenness may notably occur in some cases. It is conceivable that this is because, if the number of times to perform the scanning is high even in a case where the fluctuation of the ejection amount occurs, the density unevenness can be suppressed to some extent by the effect of the multi-pass recording method, but if the number of times to perform the scanning is low, the effect of the multi-pass recording method is reduced, and the density unevenness is not sufficiently suppressed.

Therefore, according to the present exemplary embodiment, a low value is set as the threshold in a case where the number of times to perform the scanning with respect to the unit area is relatively low to facilitate the driving of the sub heater. On the other hand, in a case where the number of times to perform the scanning is relatively high, since the density unevenness is not so conspicuous even when the temperature difference occurs, a high value is set as the threshold to make it difficult for the sub heater to be driven.

Hereinafter, an example of the driving control of the sub heater according to the present exemplary embodiment will be described in detail.

Figure 8:
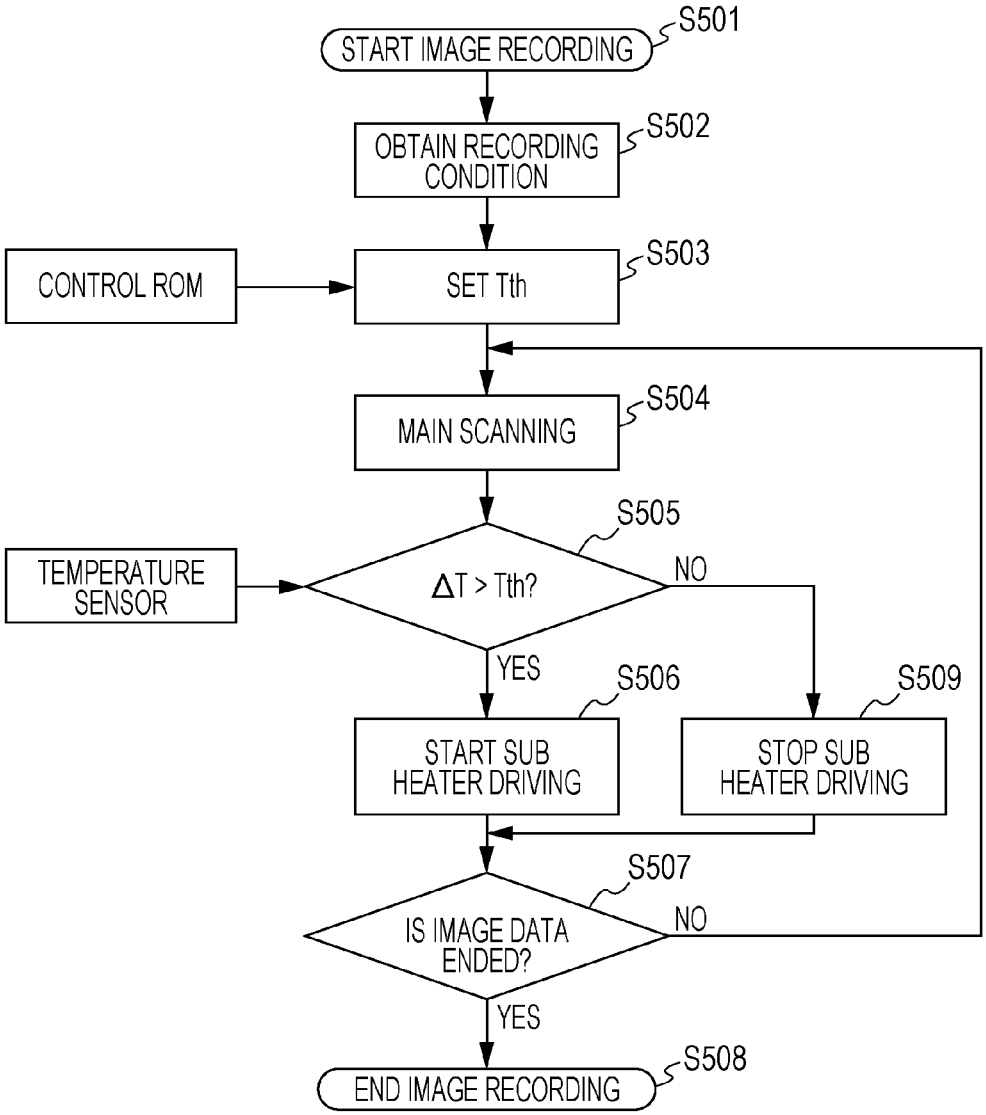
FIG. 8 is an explanatory diagram for describing the driving control of the sub heater according to the exemplary embodiment.

FIG. 8 is a flow chart for describing a flow of a control for changing the threshold of the sub heater in accordance with the number of times to perform the scanning with respect to the unit area according to the present exemplary embodiment.

First, in step S501, when the image recording is started, the MPU 102 recognizes information related to the number of times to perform the scanning with respect to the unit area as the information related to the recording condition on the basis of the information from the RAM 103 (step S502). According to the present exemplary embodiment, information on a recording mode executed when the recording is performed among a plurality of recording modes that will be described below is obtained as the information related to the number of times to perform the scanning.

The image recording apparatus according to the present exemplary embodiment can execute three recording modes including a high speed recording mode, a standard recording mode, and a high image quality recording mode. Herein, the high speed recording mode refers to a recording mode in which the scanning is performed twice with respect to the unit area to perform the recording (two-pass recording) is performed. The standard recording mode refers to a recording mode in which the scanning is performed four times with respect to the unit area to perform the recording (four-pass recording). The high image quality recording mode refers to a recording mode in which the scanning is performed eight times with respect to the unit area to perform the recording (eight-pass recording).

Herein, in a case where the temperature distribution occurs to some extent in the ejection opening array, the density unevenness derived from the temperature distribution may be more conspicuous in the image recorded in the standard recording mode than the image recorded in the high image quality recording mode at the same temperature difference. Furthermore, the density unevenness derived from the temperature distribution may be still more conspicuous in the image recorded in the high speed recording mode than the image recorded in the standard recording mode. It is conceivable that this is because the multi-pass effect can suppress the density unevenness in a case where the number of times to perform the scanning with respect to the unit area is high even at the temperature difference as the described above.

In view of the above-described point, according to the present exemplary embodiment, as illustrated in FIG. 9, any one of values is selected from among a plurality of candidate values to be set as the threshold Tth in each recording mode (step S503). For example, in the case of the two-pass recording equivalent to the high speed recording mode, 3° C. is selected as the threshold temperature difference Tth at which the driving of the sub heater is started. In the case of the four-pass recording equivalent to the standard recording mode, 5° C. is selected, and in the case of the eight-pass recording or higher equivalent to the high image quality recording mode, 10° C. is selected. It is noted that different values can be appropriately set as the thresholds Tth (° C.) in the respective recording modes described above. Appropriate values for eliminating the temperature difference in the respective recording modes can be calculated by simulations and the like, and information related to those values can be previously stored in the control ROM 105 in the recording apparatus.

When the main scanning is started in step S504, the difference (temperature difference) ΔT (° C.) between the temperature detection value from the end part temperature sensor 53 and the temperature detection value from the central part temperature sensor 54 is calculated, comparison with the threshold Tth (° C.) set in step S503 is started (step S505).

When it is determined that the temperature difference ΔT (° C.) is higher than the threshold Tth, to reduce the temperature difference between the end part side and the central side, driving of the sub heater is started (step S506). On the other hand, when it is determined that the temperature difference ΔT (° C.) is lower than or equal to the threshold Tth, the sub heater is not driven (step S509). In a case where the driving of the sub heater is already executed at that time, the driving of the sub heater is stopped.

Thereafter, it is determined whether or not the image recording is ended (step S507), and when the recording of all the data is ended, the image recording operation is ended (step S508). In a case where the recording of all the data is not ended, the flow returns to step S102, and the similar processing is continued until the data is ended.

Hereinafter, while a case where the recording is performed in the high speed recording mode and a case where the recording is performed in the standard recording mode are taken as an example, the temperature transition when the present exemplary embodiment is applied to the configuration will be described. Herein, as an example, descriptions will be given of a case where an image recorded similarly as in the first exemplary embodiment is the image of the A0 size light cyan 100% duty, the head temperature is increased to 35° C. before the recording start by the temperature adjustment control using the sub heater and the electrothermal transducing element used for ejecting the ink before the recording start, and then the recording is started.

As may be understood from FIG. 9, in a case where the recording is performed in the high speed recording mode according to the present exemplary embodiment, the threshold Tth is set as 3° C. Therefore, the temperature transition occurs as illustrated in FIG. 6B, and the substantially uniform temperature distribution can be obtained at the time of the recording end as illustrated in FIG. 7B.

On the other hand, as may be understood from FIG. 9, in a case where the recording is performed in the standard recording mode, the threshold Tth is set as 5° C. Herein, FIGS. 10A and 10B illustrate the temperature transition in a case where the image recording similar to FIGS. 6A and 6B is performed in the standard recording mode.

Figure 10A:
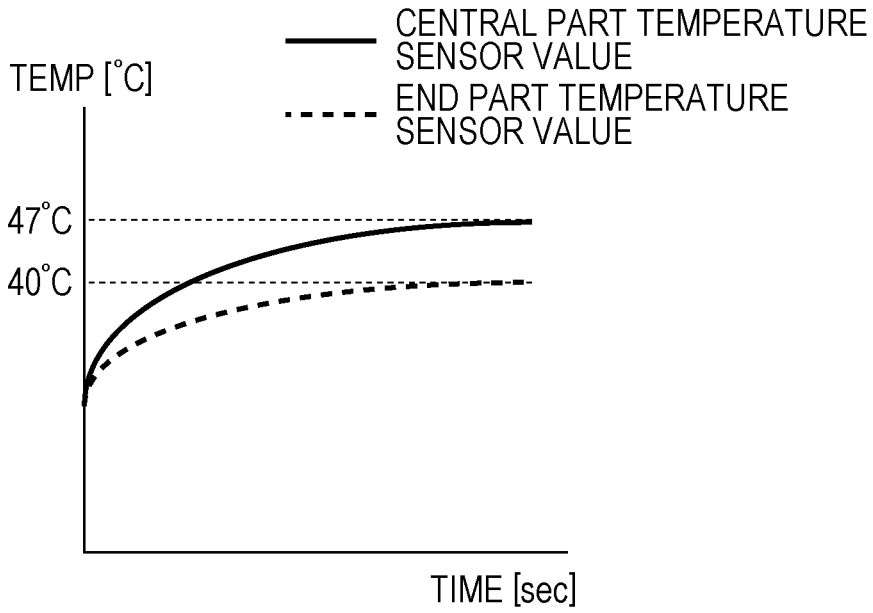
FIGS. 10A and 10B are explanatory diagrams for describing the temperature transition according to the exemplary embodiment.

FIG. 10A illustrates the temperature transition in a case where the present exemplary embodiment is not applied to the configuration. In 192 seconds later when the recording is ended, the end part temperature sensor value becomes approximately 40° C., and the central part temperature sensor value becomes approximately 47° C.

Figure 10B:
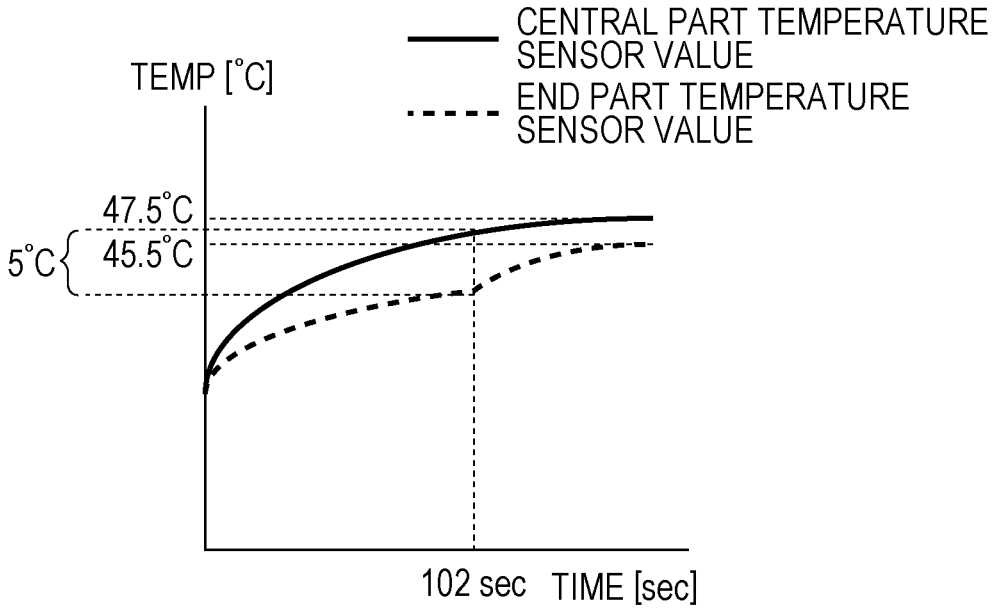

On the other hand, FIG. 10B illustrates the temperature transition in a case where the present exemplary embodiment is applied to the configuration. After an elapse of 102 seconds since the recording is started, the temperature difference between the end part temperature sensor value and the central part temperature sensor value exceeds 5° C., and the heating by the sub heater 17 is started. For that reason, the temperature difference between the end part temperature sensor value and the central part temperature sensor value is diminished, and the temperature difference at the time of the recording end is approximately 2° C. It is however noted that the temperature of the entire recording head is slightly increased because of the heating by the sub heater, and the recording is ended while the end part temperature sensor value is approximately 45.5° C., and the central part temperature sensor value is approximately 47.5° C.

Figure 11A:
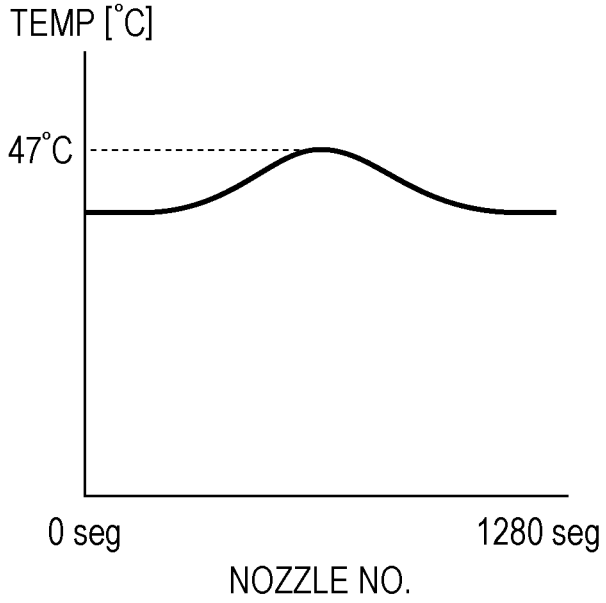
FIGS. 11A and 11B illustrate the temperature distribution according to the exemplary embodiment.
Figure 11B:
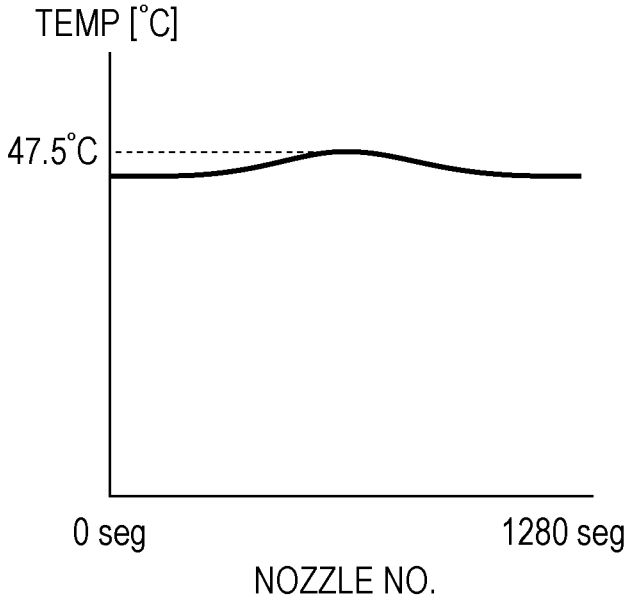

FIGS. 11A and 11B illustrate the temperature distribution of the ejection opening array 12 at the time of the recording end. It is noted that FIG. 11A illustrates the temperature distribution in a case where the present exemplary embodiment is not applied to the configuration, and FIG. 11B illustrates the temperature distribution in a case where the present exemplary embodiment is applied to the configuration.

In a case where the present exemplary embodiment is not applied to the configuration, as illustrated in FIG. 11A, the temperature distribution in which the temperature of the central part in the ejection opening array is high and the temperature of the end part is low is obtained. In contrast to this, by applying the present exemplary embodiment to the configuration, as illustrated in FIG. 11B, the temperature distribution of the ink in the ejection opening array becomes substantially uniform in the Y direction.

In this manner, according to the present exemplary embodiment, different thresholds are set in accordance with the number of times to perform the scanning with respect to the unit area. The sub heater is driven in a case where the temperature difference is higher than the threshold, and the driving of the sub heater is stopped in a case where the temperature difference is lower than or equal to the threshold. Thus, the temperature distribution in the ejection opening array (in the recording element array) is set to be substantially uniform, and the density unevenness derived from the temperature distribution can be appropriately suppressed. In the high speed recording mode, the number of times to perform the scanning is low, and the density unevenness derived from the temperature distribution in the ejection opening array may be easily visibly recognized. However, according to the present exemplary embodiment, the temperature difference between the central part temperature sensor value and the end part temperature sensor value can be reduced to approximately 1° C. Accordingly, it is possible to effectively suppress the density unevenness derived from the temperature distribution in the ejection opening array. On the other hand, since the multi-pass effect may be more easily attained in the standard recording mode than the high speed recording mode, the temperature distribution in the ejection opening array is not easily visibly recognized as the density unevenness. For that reason, according to the present exemplary embodiment, although the temperature difference between the central part temperature sensor value and the end part temperature sensor value becomes approximately 2° C., it is possible to effectively suppress the density unevenness.

In addition, a result is obtained that the central part temperature sensor value is increased by approximately 2° C. at the time of the recording end by the execution of the sub heater control in the high speed recording mode as compared with a case where the sub heater control is not executed. If the above-described control is continued, the entire recording head accumulates the heat, and the temperature is increased. Therefore, instability of the ejection accompanied by the excess temperature increase may be caused in some cases. In view of the above, in the standard recording mode according to the present exemplary embodiment, it is possible to minimize the period during which the sub heater control is executed by setting the threshold at which the sub heater control is started to be higher than that in the high speed recording mode. Therefore, it is possible to suppress the temperature increase to approximately 0.5° C. in the standard recording mode.

Third Exemplary Embodiment

According to the second exemplary embodiment, the descriptions have been given of the mode in which the threshold for driving the sub heater is determined in accordance with the number of times to perform the scanning with respect to the unit area as the recording condition.

In contrast to this, according to the present exemplary embodiment, descriptions will be given of a mode in which the threshold for driving the sub heater is determined in accordance with a recording condition other than the number of times to perform the scanning.

It is noted that descriptions on parts similar to the above-described first and second exemplary embodiments will be omitted.

As described above, even when the temperature distribution in the ejection opening array is the same, a degree of the density unevenness derived from the temperature distribution may differ in accordance with the type of the recording medium, the recording duty, or the humidity in the vicinity of the surface of the recording medium when the recording is performed. It is noted that the recording duty according to the present exemplary embodiment refers to a ratio of the number of pixel areas where the ink is actually ejected to the number of pixel areas where the ink can be ejected with respect to the unit area on the recording medium. The pixel area is an area in the unit area equivalent to a pixel and refers to an area where the ink of the same can be supplied by only a single droplet at a maximum. For example, an image of the 100% recording duty is a so-called solid image formed while the ink is ejected to all the pixel areas in the unit area. An image of the 0% recording duty is an image where the ink is not ejected to any of the pixel areas in the unit area. In this manner, it may be understood that the recording duty is in proportion to the ejection amount of the ink ejected with respect to the unit area.

For example, since the ink easily bleeds on the plain paper among the plain paper, the coated paper, and the glossy paper, it is difficult to visibly recognize the density unevenness derived from the temperature distribution even if the density unevenness is generated. On the other hand, since it is difficult for the ink to be bled on the glossy paper, the visibility of the density unevenness derived from the temperature distribution is high.

In a case where the image to be recorded correspond to a middle gray scale (for example, the recording duty is 30 to 50%), the fluctuation of the coverage on the recording medium of the ink droplet at the time of the recording position misalignment is large as compared with the case of a low gray scale (for example, the recording duty is 0 to 30%) or the case of a high gray scale (for example, the recording duty is 50 to 100%). For that reason, the density unevenness derived from the temperature distribution is more easily visibly recognized in the middle gray scale than the high gray scale or the low gray scale.

Furthermore, a rate of moisture absorption of the recording medium in a case where the humidity is low is different from that in a case where the humidity detected by a humidity sensor (humidity detection unit) is high, and it becomes more difficult for the ink to be bled. For that reason, in a case where the density unevenness derived from the temperature distribution occurs, the density unevenness is easily visibly recognized.

In view of the above-described point, according to the present exemplary embodiment, information related to any one of the type of the recording medium, the recording duty, and the humidity in the vicinity of the surface of the recording medium is obtained as the information related to the recording condition in step S502 of FIG. 8. Subsequently, an appropriate threshold is selected in accordance with the recording condition in step S503 of FIG. 8 to perform the driving control of the sub heater.

FIGS. 12A, 12B, and 12C are table diagrams illustrating the thresholds for driving the sub heater. It is noted that FIGS. 12A, 12B, and 12C respectively illustrate the appropriate thresholds in accordance with the type of the recording medium, the recording duty, and the humidity.

For example, a setting is made in a manner that the threshold is relatively high in a case where the type of the recording medium is the plain paper where the density unevenness is less likely to be conspicuous, and the threshold is relatively low in a case where the glossy paper where the density unevenness is more likely to be conspicuous. When the image of the middle gray scale where the density unevenness is more likely to be conspicuous is recorded, the threshold is set to be relatively low as compared with the case where the image of the high gray scale or the low gray scale is recorded. Since the density unevenness is more likely to be conspicuous in a case where the humidity is low, the threshold is set to be relatively low as compared with the case where the humidity is high.

According to the present exemplary embodiment, even in a case where the density unevenness derived from the temperature distribution is more likely to be conspicuous depending on the type of the recording medium, the recording duty, or the humidity, it is possible to perform the recording while the density unevenness is appropriately suppressed.

Fourth Exemplary Embodiment

According to the present exemplary embodiment, a threshold temperature difference at which the sub heater control is driven is set in accordance with a detected temperature of the temperature sensor.

It is noted that descriptions on parts similar to the above-described first to third exemplary embodiments will be omitted.

Figure 13:
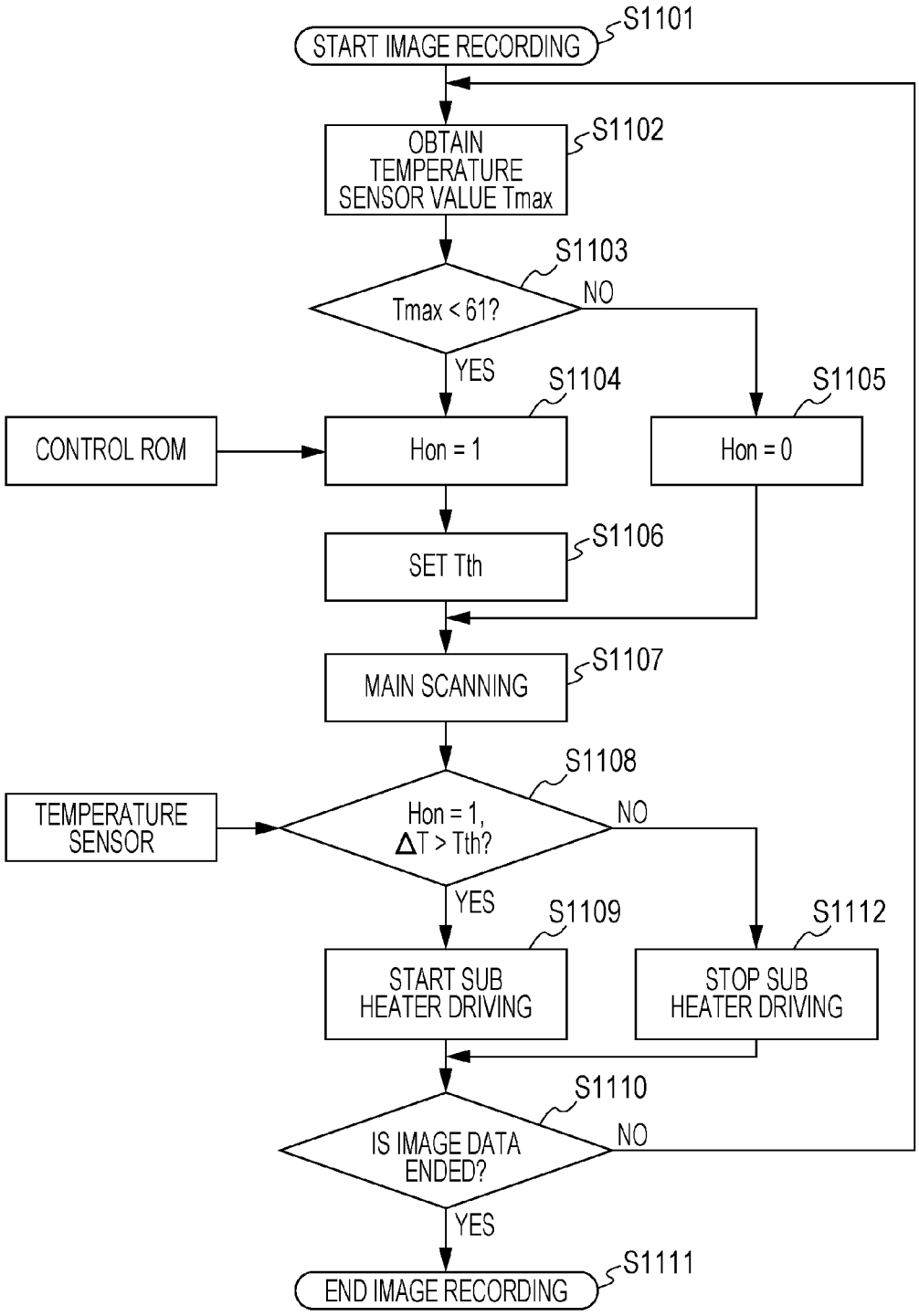
FIG. 13 is an explanatory diagram for describing the driving control of the sub heater according to the exemplary embodiment.

FIG. 13 is a flow chart illustrating a flow of a control for setting a threshold at which the sub heater control is started in accordance with the detected temperature of the temperature sensor in the central part during the recording.

FIG. 14 is a table diagram illustrating an appropriate threshold temperature in accordance with the detected temperature of the temperature sensor.

First, when the image recording is started in step S1101, a highest reaching temperature Tmax (° C.) at that time among detected temperatures of the temperature sensor in the central part is obtained (step S1102). In a case where Tmax is higher than or equal to 61° C. (step S1103), 0 is set as a sub heater control starting flag Hon (step S1105). In a case where Tmax is lower than 61° C., 1 is set as the sub heater control starting flag Hon (step S1104), and also the threshold Tth at which the sub heater control is started in accordance with Tmax is set on the basis of the table illustrated in FIG. 14 (step S1106).

At the same time when the main scanning is started (step S1107), a state of the sub heater control starting flag is checked, and also comparison of the difference ΔT (° C.) between the temperature detection value from the end part temperature sensor 53 and the temperature detection value from the central part temperature sensor 54 with the threshold Tth (° C.) set in step S1106 is started (step S1108) When it is detected that the sub heater control starting flag Hon is 1, and also the difference ΔT of the temperature detection values (° C.) becomes higher than the threshold Tth (° C.) set from the highest reaching temperature of the central part temperature sensor, the control of the sub heater is started such that the temperature difference between the end part temperature sensor and the central part temperature sensor is decreased (step S1109). On the other hand, in a case where the temperature difference ΔT is lower than or equal to the threshold Tth, the driving of the sub heater is stopped (step S1112).

Thereafter, it is determined whether or not the image recording is ended (step S1110), and when the recording of all the data is ended, the image recording operation is ended (step S1111).

According to the above-described control, under the conditions where the temperature of the ejection opening array is low, and a concern that the temperature difference between the central part and the end part may be abruptly expanded in a case where the recording of the high duty image is performed exists, the sub heater control is started early, and the occurrence of the density unevenness can be avoided. On the other hand, in a case where the temperature of the ejection opening array is high, and the support substrates also involve the heat accumulation, a probability that the temperature difference is abruptly expanded is small even when the recording of the high duty image is performed. For that reason, the sub heater control does not need to be started in advance, and the start of the sub heater control is delayed until the temperature difference to such an extent that the density unevenness does not occur is reached, and it is possible to avoid the excess temperature increase of the recording head. In addition, in a case where the temperature of the ejection opening array is about to reach the temperature area where the excess temperature increase may occur (61° C. or higher according to the present exemplary embodiment), the driving of the sub heater is not performed, and it is possible to prioritize the ejection performance of the recording head.

Figure 15A:
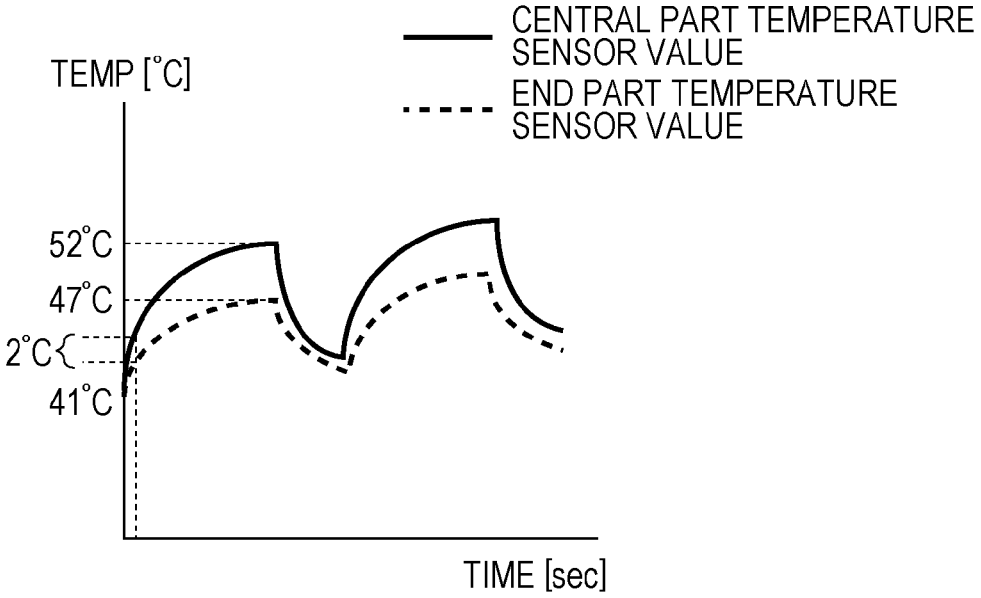
FIGS. 15A and 15B are explanatory diagrams for describing the temperature transition according to the exemplary embodiment.
Figure 15B:
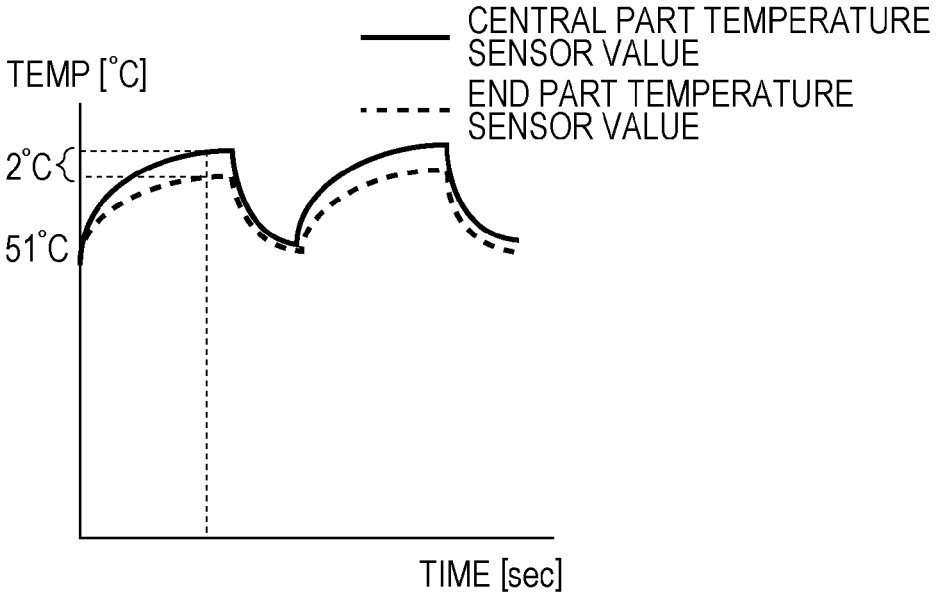

FIGS. 15A and 15B illustrate the temperature transition for performing the scanning twice after the recording start when the recording in the high speed recording mode similar to the first exemplary embodiment is executed in a case where the central part temperature sensor value is 41° C. and a case where this value is 51° C.

FIG. 15A illustrates the transition of the central part temperature sensor value and the end part temperature sensor value in a case where the recording is started from a state in which the central part temperature sensor value is 41° C. Immediately after the recording is started, the temperature difference between the temperature sensors exceeds 2° C., and at the time when the first scanning is ended, the end part temperature sensor value is increased to 47° C., and the central part temperature sensor value is increased to 52° C. Therefore, the temperature difference exceeds 4° C. at which the density unevenness is visibly recognized in the high speed recording mode. In view of the above, if the sub heater control is stated when the temperature difference reaches 2° C. according to the present exemplary embodiment, it is possible to suppress the temperature difference expansion during the recording. The temperature difference can be set as approximately 3° C. according to the present exemplary embodiment.

On the other hand, FIG. 15B illustrates the temperature transition in a case where the recording is started from a state in which the central part temperature sensor is 51° C. Since the recording head itself accumulates the heat at the time of the recording start, the temperature increase transition by the recording is moderate, and the temperature difference between the temperature sensors stays at approximately 2.5° C. even at the time of the recording end. Therefore, the sub heater control does not necessarily need to be started immediately after the temperature difference reaches 2° C. as in the case where the recording start temperature is 41° C. According to the present exemplary embodiment, since 3.5° C. that is short of approximately 4° C. at which the density unevenness may occur is set as the threshold at which the control of the sub heater is started, the sub heater is not driven in the two-scanning recording, and it is possible to avoid the further excess temperature increase of the recording head.

As described above, the temperature distribution in the ejection opening array is eliminated by carrying out the exemplary embodiment of the present invention, and the density unevenness can be avoided. In addition to the above, it is also possible to suppress the decrease in the ejection performance while the excess temperature increase of the recording head is avoided.

It is noted that the configuration has been adopted in which the threshold temperature difference at which the sub heater control is started is set in accordance with the temperature of the central part temperature sensor value according to the present exemplary embodiment, but the value of the end part temperature sensor may be used, or a completely different temperature sensor may also be used. As long as the temperature in the vicinity of the ejection opening array can be detected as the recording condition, any sensor value may be used.

In addition, the configuration has been adopted in which the sub heater control is not executed in a case where a risk of the excess temperature increase exists in the recording head according to the present exemplary embodiment, but the similar effects can be attained when a configuration in which the input energy to the sub heater is reduced by decreasing the driving duty of the sub heater, reducing the driving time, or the like.

Fifth Exemplary Embodiment

According to the present exemplary embodiment, the threshold temperature difference at which the sub heater is driven and the threshold temperature difference at which the driving of the sub heater is ended are set to have different thresholds.

It is noted that descriptions on parts similar to the above-described first to fourth embodiments will be omitted.

Figure 16:
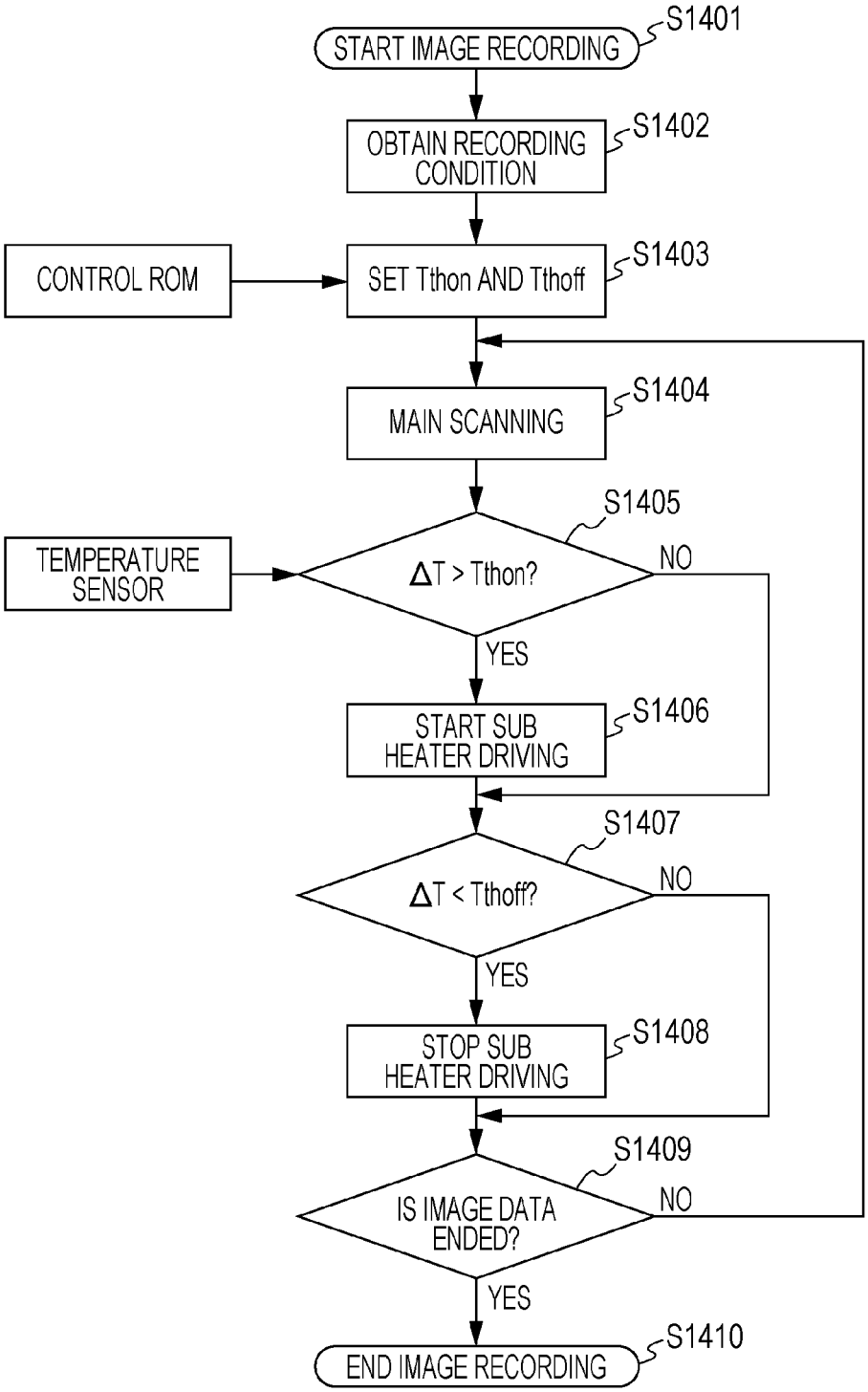
FIG. 16 is an explanatory diagram for describing the driving control of the sub heater according to the exemplary embodiment.

FIG. 16 is a flow chart for describing a flow of a control in which the threshold temperature difference at which the sub heater control is started and the threshold temperature difference at which the sub heater control is ended are set to have different thresholds.

First, when the image recording is started in step S1401, the MPU 102 obtains the information related to the number of times to perform the scanning with respect to the unit area on the basis of the information from the control ROM 105 (step S1402). Next, as illustrated in FIG. 17, a reference is made to a setting table of a threshold temperature difference Tthon at which the sub heater control is started and a threshold temperature difference (predetermined value) Tthoff at which the sub heater control is stopped in each of the recording modes corresponding to the number of times to perform the scanning, and the threshold temperature difference is set in the relevant recording mode (step S1403). Herein, the threshold temperature difference Tthoff at which the sub heater control is stopped is set to be lower than the threshold temperature difference Tthon at which the sub heater control is started in each of the recording modes.

At the same time when the main scanning is started (step S1404), comparison of the difference ΔT (° C.) between the temperature detection value from the end part temperature sensor 53 and the temperature detection value from the central part temperature sensor 54 with the threshold Tthon (° C.) set in step S1403 is started (step S1405). When it is detected that the difference ΔT of the temperature detection values (° C.) is higher than the threshold Tthon (° C.) set from the recording mode, the sub heater is configured to be driven so as to reduce the temperature difference between the end part temperature sensor and the central part temperature sensor (step S1406). Next, it is determined whether or not the difference ΔT (° C.) of the temperature detection values is lower than or equal to the threshold Tthoff set in step S1403 (is lower than or equal to a predetermined value) (step S1407), and when it is detected that the difference is lower than or equal to Tthoff, the sub heater is stopped (step S1408).

Thereafter, it is determined whether or not the image recording is ended (step S1409), and when the recording of all the data is ended, the image recording operation is ended (step S1410).

Figure 18A:
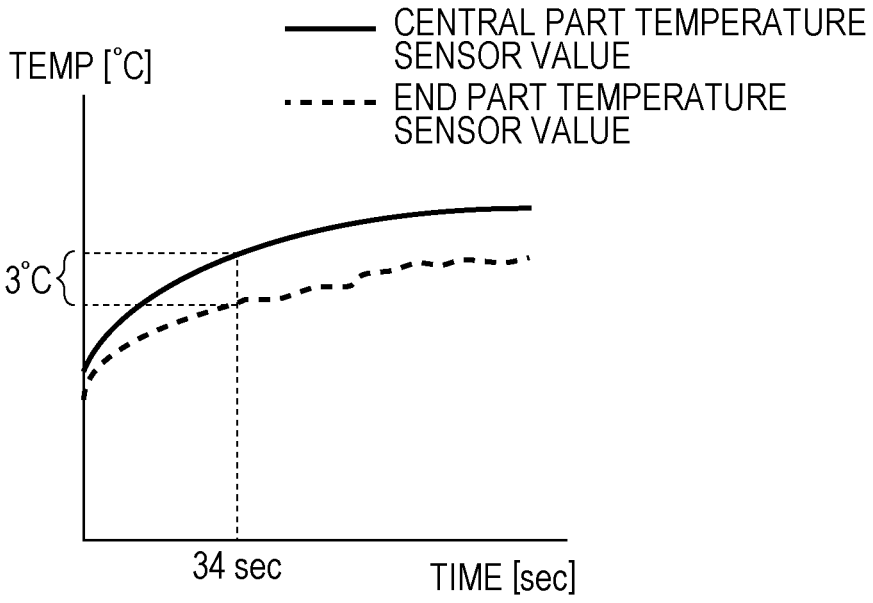
FIGS. 18A and 18B are explanatory diagrams for describing the temperature transition according to the exemplary embodiment.

According to the above-described control, as compared with the case where the sub heater drive temperature is the same as the sub heater stop temperature, the heating time by the sub heater can be sufficiently secured, and it is facilitated to attain the effect of setting the temperature difference between the central part and the end part in the ejection opening array to be uniform. For example, FIG. 18A illustrates the temperature transition when the drive temperature and the stop temperature of the sub heater are set be the same (3° C. in this case) in a case where the recording of the A0 size light cyan 100% duty image similar to that in the first exemplary embodiment is executed in the high speed recording mode. The difference between the central part temperature sensor value and the end part temperature sensor value becomes 3° C. in 34 seconds after the recording start, and the driving of the sub heater is started. However, the end part temperature sensor value is momentarily increased by the heating effect by the sub heater. As a result, the temperature difference becomes below 3° C., and immediately after that, the sub heater is stopped. Subsequently, the sub heater repeats the control ON and OFF, and the recording is ended while the temperature difference between the end part temperature sensor value and the central part temperature sensor value is hardly reduced and remains approximately 3° C.

Figure 18B:
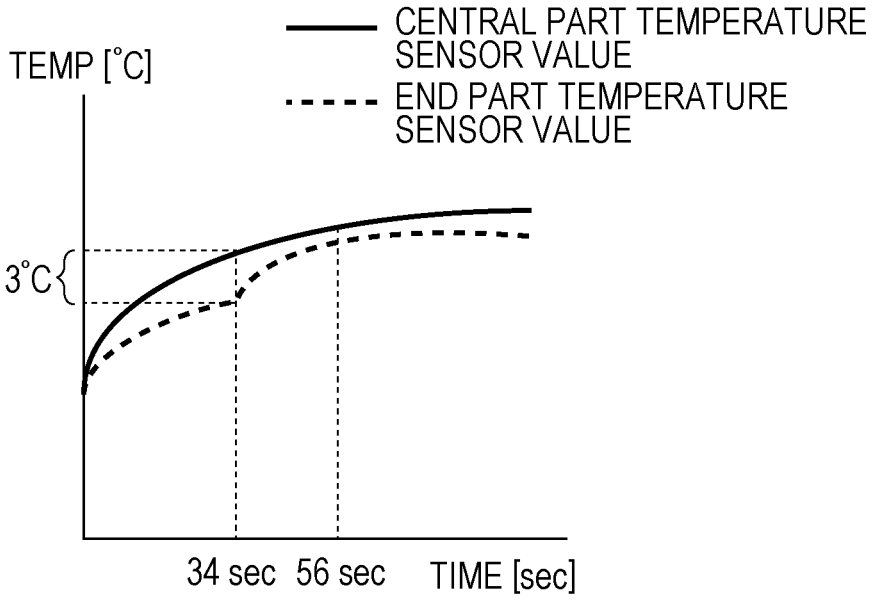

On the other hand, FIG. 18B illustrates the temperature transition in a case where the threshold Tthoff (° C.) at which the sub heater control is stopped is set to be lower than the threshold Tthon (° C.) at which the sub heater control is started as illustrated in FIG. 17. The temperature difference becomes 3° C. in 34 seconds after the recording start and exceeds Tthon (° C.), and the sub heater control is started. After that, the end part temperature sensor value is increased by the heating effect by the sub heater, and the temperature difference with the central part temperature sensor value becomes below 3° C. but is not below Tthoff (° C.), so that the sub heater control is continued. In 56 seconds after the recording start, the temperature difference is below 1° C., and the sub heater control is stopped. Since the sub heater control is stopped, the increase in the end part temperature sensor value is stagnated, and the temperature difference with the central part temperature sensor value is expanded. However, the recording is ended while the temperature difference is within 3° C., and the sub heater control is not resumed. The temperature difference at the time of the recording end is becomes approximately 1.5° C., and the temperature difference is diminished as compared with the case where the start temperature and the stop temperature of the sub heater control have the same setting.

In this manner, by setting the threshold temperature difference Tthoff at which the sub heater control is stopped to be lower than the threshold temperature difference Tthon at which the sub heater control is started, the heating time does not run short by the frequent ON/OFF control of the sub heater, and the sub heater control is sufficiently continued, so that it becomes facilitated to reduce the temperature difference between the central part and the end part in the ejection opening array. In addition, as illustrated in FIGS. 15A and 15B, the difference between the threshold Tthon (° C.) at which the sub heater control is started and the threshold Tthoff (° C.) at which the sub heater control is stopped can be changed in accordance with the number of times to perform the scanning with respect to the unit area. Accordingly, the excess temperature increase of the recording head is avoided in such a manner, for example, that the sub heater control can be continued for a sufficiently long time in a case where the risk of the occurrence of the density unevenness is high, and the sub heater control is kept to a minimum in a case where the risk of the occurrence of the density unevenness is low, and an optimal control can be carried out.

As described above, according to the present exemplary embodiment, not only the temperature distribution in the ejection opening array is set to be uniform, and the density unevenness can be suppressed, but also the decrease in the ejection performance by the excess temperature increase of the recording head can be suppressed.

It is noted that the configuration has been adopted in which the start temperature and the stop temperature of the sub heater are set in accordance with the number of times to perform the scanning with respect to the unit area according to the present exemplary embodiment, but the other mode can also be executed. For example, a configuration may be adopted in which the start temperature and the stop temperature of the sub heater is set in accordance with the type of the recording medium, the recording duty, the humidity in the vicinity of the surface of the recording medium, or the temperature of the ink in the ejection opening array. The start temperature and the stop temperature of the sub heater control may be set to be different from each other also according to a mode in which previously set thresholds are used similarly as in the first exemplary embodiment.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the respective exemplary embodiments described above, the recording head having the mode in which the sub heater is arranged so as to surround the ejection opening arrays 11 to 13 is used, but the other mode can also be executed. The similar effect can be attained according to a mode in which the temperature difference between the end part temperature and the central part temperature in the ejection opening array is reduced by arranging a plurality of sub heaters in the vicinity of the ejection openings, for example.

In addition, according to the respective exemplary embodiments described above, the mode has been described in which the driving of the sub heater is regularly controlled in accordance with the temperature difference, but the other mode can also be executed. For example, to suppress the decrease in the ejection amount or the non-ejection that occurs when the temperature is notably low as in the related art, the mode be combined with a mode in which the sub heater is driven in a case where the detected temperature is lower than or equal to the predetermined threshold and the driving of the sub heater is stopped in a case where the detected temperature is higher than the predetermined threshold. In this case, for example, a mode may be adopted in which (i) the sub heater is driven in a case where the detected temperature is lower than or equal to 40° C., (ii) the driving of the sub heater is stopped in a case where the detected temperature is higher than 40° C., and also the temperature difference is lower than or equal to 3° C., and (iii) the sub heater is driven again to eliminate the temperature difference in a case where the detected temperature is higher than 40° C., and also the temperature difference is higher than 3° C. It is noted that, as the temperature of this case, any one of the end part temperature sensor and the central part temperature sensor may be used as a representative temperature, or an average value of the two values may also be used as the representative temperature.

Furthermore, according to the respective exemplary embodiments described above, the mode has been described in which the image is recorded by performing the scanning on the recording medium plural times, but the other mode can also be executed. For example, the respective exemplary embodiments can also be applied to a mode in which a long recording head having a length longer than the width direction of the recording medium is used, and the ink is ejected from the recording head to recording the time while the recording medium is conveyed once in a direction intersecting with the width direction.

Moreover, the controls according to the respective exemplary embodiments described above can also be executed in combination. For example, the driving of the sub heater may be controlled in accordance with both the number of times to perform the scanning with respect to the unit area and the value of the central part temperature sensor as the recording condition. In this case, in the driving control of the sub heater illustrated in FIG. 13, in a case where the sub heater control starting flag Hon is 1, in step S1106, the threshold Tth may be determined while following the table in which the threshold for driving the sub heater is set in accordance with the number of times to perform the scanning with respect to the unit area and the value of the central part temperature sensor respectively illustrated in FIGS. 19A, 19B, and 19C.

The image recording apparatus and the image recording method according to the respective exemplary embodiments have been described, but the invention may include an image processing apparatus and an image processing method with which data for performing the image recording method described in the respective exemplary embodiments is generated. Furthermore, the present invention can be widely applied to a mode in which a program that causes the image recording apparatus to function is prepared in a separate form from the image recording apparatus, a mode in which the program is provided to a part of the image recording apparatus, and the like.

With the image recording apparatus, the image recording method, and the non-transitory computer-readable storage medium according to the exemplary embodiment of the present invention, it is possible to perform the recording while the density unevenness derived from the temperature distribution is suppressed in a manner that the temperature in the central part side in the ejection opening array is set to be higher than the temperature in the end part side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-109047, filed May 27, 2014, which is hereby incorporated by reference herein in its entirety.

What is claimed is:

1. An image recording apparatus comprising:

a recording head including at least a substrate, a recording element array in which a plurality of recording elements that are arranged on the substrate in a predetermined direction and generate thermal energy for ejecting ink of a predetermined color, a first detection element that detects a temperature in a vicinity of the recording element at a first position in the predetermined direction in the recording element array, a second detection element that detects a temperature in a vicinity of the recording element at a second position that is different from the first position in the predetermined direction in the recording element array, and a heating element that performs heating of ink in the vicinity of the recording elements at the first position and the second position among the plurality of the recording elements arranged in the recording element array; and a control unit that controls the heating by the heating element on the basis of the temperatures detected by the first and second detection elements, wherein the control unit controls the heating by the heating element in a manner that the heating by the heating element is executed in a case where a temperature difference between the temperature detected by the first detection element and the temperature detected by the second detection element is higher than a first threshold.

2. The image recording apparatus according to claim 1, wherein the control unit controls the heating by the heating element in a manner that the heating by the heating element is stopped in a case where the temperature difference is lower than or equal to a second threshold.

3. The image recording apparatus according to claim 2, wherein the first position is one end part in the predetermined direction in the recording element array, and the second position is a central part in the predetermined direction in the recording element array.

4. The image recording apparatus according to claim 3, wherein the heating element performs centrally heating of ink in the vicinity of the recording element at the first position rather than heating of ink in the vicinity of the recording element at the second position.

5. The image recording apparatus according to claim 2, wherein the heating element is arranged at least in the vicinity of the one end part in the predetermined direction in the recording element array in the recording head.

6. The image recording apparatus according to claim 2, further comprising:

an obtaining unit that obtains information related to a recording condition when an image is recorded; and a determination unit that determines the first threshold on the basis of the recording condition indicated by the information obtained by the obtaining unit.

7. The image recording apparatus according to claim 6, further comprising:

a scanning unit that can scan the recording head with respect to a unit area on the recording medium plural times, wherein the obtaining unit obtains information related to a number of times to perform the scanning with respect to the unit area of the recording head by the scanning unit as the information related to the recording condition, and wherein the control unit (i) determines a first value as the first threshold in a case where the number indicated by the information obtained by the obtaining unit is a first number of times and (ii) determines a second value that is lower than the first value as the first threshold in a case where the number indicated by the information obtained by the obtaining unit is a second number of times which is lower than the first number of times.

8. The image recording apparatus according to claim 6, wherein the obtaining unit obtains information related to an ejection amount of the ink ejected with respect to the unit area on the recording medium as the information related to the recording condition, and wherein the control unit (i) determines a third value as the first threshold in a case where the ejection amount indicated by the information obtained by the obtaining unit is a first amount and (ii) determines a fourth value that is lower than the third value as the first threshold in a case where the ejection amount indicated by the information obtained by the obtaining unit is a second amount that is lower than the first amount.

9. The image recording apparatus according to claim 8, wherein the control unit determines a fifth value that is higher than the fourth value as the first threshold in a case where the ejection amount indicated by the information obtained by the obtaining unit is a third amount that is lower than the second amount.

10. The image recording apparatus according to claim 6, wherein the obtaining unit obtains information related to a type of the recording medium as the information related to the recording condition, and wherein the control unit (i) determines a sixth value as the first threshold in a case where the type of the recording medium indicated by the information obtained by the obtaining unit is plain paper and (ii) determines a seventh value that is lower than the sixth value as the first threshold in a case where the type of the recording medium indicated by the information obtained by the obtaining unit is coated paper.

11. The image recording apparatus according to claim 10, wherein the control unit determines an eighth value that is lower than the seventh value as the first threshold in a case where the type of the recording medium indicated by the information obtained by the obtaining unit is glossy paper.

12. The image recording apparatus according to claim 6, wherein the obtaining unit obtains information related to a type of the recording medium as the information related to the recording condition, and wherein the control unit (i) determines a ninth value as the first threshold in a case where the type of the recording medium indicated by the information obtained by the obtaining unit is plain paper and (ii) determines a tenth value that is lower than the ninth value as the first threshold in a case where the type of the recording medium indicated by the information obtained by the obtaining unit is glossy paper.

13. The image recording apparatus according to claim 6, further comprising:

a humidity detection unit that detects a humidity in a vicinity of a surface of the recording medium when the ink is ejected onto the recording medium, wherein the obtaining unit obtains information related to the humidity detected by the humidity detection unit as the information related to the recording condition, and wherein the control unit (i) determines an eleventh value as the first threshold in a case where the humidity indicated by the information obtained by the humidity detection unit is a first humidity and (ii) determines a twelfth value that is lower than the eleventh value as the first threshold in a case where the humidity indicated by the information obtained by the humidity detection unit is a second humidity that is lower than the first humidity.

14. The image recording apparatus according to claim 6, wherein the obtaining unit obtains information related to any one of the temperatures including the temperature detected by the first detection element and the temperature detected by the second detection element as the information related to the recording condition, and wherein the control unit (i) determines a thirteenth value as the first threshold in a case where the temperature indicated by the information obtained by the obtaining unit is a first temperature and (ii) determines a fourteenth value that is lower than the thirteenth value as the first threshold in a case where the temperature indicated by the information obtained by the obtaining unit is a second temperature that is lower than the first temperature.

15. The image recording apparatus according to claim 6, wherein the determination unit determines the first threshold from among a plurality of candidate values in accordance with the recording condition indicated by the information obtained by the obtaining unit.

16. The image recording apparatus according to claim 2, wherein the second threshold is a same value as the first threshold.

17. The image recording apparatus according to claim 2, wherein the second threshold is a value lower than the first threshold.

18. The image recording apparatus according to claim 2, further comprising:

a second obtaining unit that obtains a representative temperature on the basis of the temperatures detected by the first and second detection elements, wherein the control unit controls the heating by the heating element in a manner that (i) the heating by the heating element is executed in a case where the representative temperature obtained by the second obtaining unit is lower than or equal to a third threshold, (ii) the heating by the heating element is executed in a case where the representative temperature obtained by the second obtaining unit is higher than the third threshold, and also the temperature difference is higher than the first threshold, and (iii) the heating by the heating element is stopped in a case where the representative temperature obtained by the second obtaining unit is higher than the third threshold, and also the temperature difference is lower than or equal to the second threshold.

19. The image recording apparatus according to claim 2, wherein the recording element array has the plurality of recording elements arranged in a range longer than a width in the predetermined direction of the recording medium.

20. An image recording method comprising:

using a recording head including at least a substrate, a recording element array in which a plurality of recording elements that are arranged on the substrate in a predetermined direction and generate thermal energy for ejecting ink of a predetermined color, a first detection element that detects a temperature in a vicinity of the recording element at a first position in the predetermined direction in the recording element array, a second detection element that detects a temperature in a vicinity of the recording element at a second position that is different from the first position in the predetermined direction in the recording element array, and a heating element that performs heating of ink in the vicinity of the plurality of recording elements arranged in the recording element array; and controlling the heating by the heating element on the basis of the temperatures detected by the first and second detection elements to record an image, wherein the heating by the heating element is controlled in a manner that the heating by the heating element is executed in a case where a temperature difference between the temperature detected by the first detection element and the temperature detected by the second detection element is higher than a first threshold, and also the heating by the heating element is stopped in a case where the temperature difference is lower than or equal to a second threshold.

21. A non-transitory computer-readable storage medium storing a program that causes a computer to execute the image recording method according to claim 20.

22. An image recording apparatus comprising:

a recording head including at least a substrate, a recording element array in which a plurality of recording elements that are arranged on the substrate in a predetermined direction and generate thermal energy for ejecting ink of a predetermined color, a first detection element that detects a temperature in a vicinity of the recording element at one end part in the predetermined direction in the recording element array, a second detection element that detects a temperature in a vicinity of the recording element at a central part in the predetermined direction in the recording element array, and a heating element that performs centrally heating of ink in the vicinity of the recording element at the one end part rather than heating of ink in the vicinity of recording element at the central part; and a control unit that controls the heating by the heating element on the basis of the temperatures detected by the first and second detection elements, wherein the control unit controls the heating by the heating element in a manner that the heating by the heating element is executed in a case where a temperature difference between the temperature detected by the first detection element and the temperature detected by the second detection element is higher than a predetermined threshold.

* * * * *